US005954325A

United States Patent [19]

Nagao

[11] Patent Number: 5,954,325

[45] Date of Patent: Sep. 21, 1999

[54] AUTOMATIC DOCUMENT FEEDER

[75] Inventor: Tsuyoshi Nagao, Osaka, Japan

[73] Assignee: Mita Industrial Co., Ltd., Osaka, Japan

[21] Appl. No.: 08/845,056

[22] Filed: Apr. 21, 1997

[30] Foreign Application Priority Data

| | | | |
|---|---|---|---|
| Jun. 4, 1996 | [JP] | Japan | 8-141252 |
| Jun. 4, 1996 | [JP] | Japan | 8-141253 |
| Jun. 28, 1996 | [JP] | Japan | 8-170085 |

[51] Int. Cl.[6] ..... B65H 5/22

[52] U.S. Cl. ..... 271/3.05; 271/3.07; 271/3.14; 271/184; 271/200; 271/314

[58] Field of Search ..... 271/3.01, 3.05, 271/3.07, 3.14, 5, 184, 200, 314

[56] References Cited

U.S. PATENT DOCUMENTS

| | | | |
|---|---|---|---|
| 4,469,319 | 9/1984 | Robb et al | 271/3.05 |
| 4,469,436 | 9/1984 | Jones et al. | 271/3.07 X |

FOREIGN PATENT DOCUMENTS

| | | | |
|---|---|---|---|
| 2232406 | 12/1990 | United Kingdom | 271/3.05 |

*Primary Examiner*—David H. Bollinger

*Attorney, Agent, or Firm*—Smith, Gambrell & Russell Beveridge, DeGrandi, Weilacher & Young Intellectual Property Group

[57] ABSTRACT

An automatic document feeder feeds documents placed on a document table to a document exposure position, and has a document discharge means having a discharge roller for discharging the document after exposure onto the document table, the document discharge means being movable in the document conveying direction. The automatic document feeder includes a drive pulley mounted on an end portion of the discharge roller; a pair of transmission pulleys disposed outside the moving range of the drive pulley in the document conveying direction, and rotatably supported at a stationary part; a timing belt looped between the pair of transmission pulleys and the drive pulley; and a drive source transmittingly connected to one of the pair of transmission pulleys and disposed at a stationary part.

9 Claims, 18 Drawing Sheets

11
302
30
301
266
262
24
692b
692a
261
26
32
264
28
281
282
701
702
742
741
74
72
693
691
691b
666
694
692a
692b
692
692
64
67
664
691a
63
65
662
661
663
66
691c
667
631
681
682
632
622
621
62
623

880c
89
88
881
880a
832
812
885
886
887
85
881b
880
880b
884
862a
862
86
861
861b
861a
87
870
910
910
870a
881a
902
902a
901
903a
903
900
831
83
912a
912
913
911
82
821
822
80
81
811

880c
89
881
832
88
814
881a
800
80
81
880a
83
831
992b
816
817
991
993c
992
992a
842
842b
993b
812
842a
818
993
814a
990
822
815
885
993a
821
886
84
887
82
841b
841
841a
912a
85
881a
881b
870a
912
811
880
913
880b
884
862a
862
86
861
861b
861a
87
870
910
911
910

AUTOMATIC DOCUMENT FEEDER

FIELD OF THE INVENTION

This invention relates to an automatic document feeder to be mounted on a document processor such as an electrostatic copier. More specifically, the invention relates to a so-called recirculation type automatic document feeder constructed such that set documents placed on a document table are fed one by one, subjected to image processing, and then discharged onto the set documents from the upstream side of the document table in the document conveying direction.

DESCRIPTION OF THE PRIOR ART

In recent years, with the speeding and automation of copying, copiers have come to use an automatic document feeder which automatically feeds a plurality of documents successively to a document setting position on the top of a transparent platen. The automatic document feeder put to practical use is a so-called recirculation type one in which set documents placed on a document table are fed one by one, image-processed, and then discharged onto the set documents from the upstream side of the document table in the document conveying direction. The recirculating automatic document feeder is disclosed, for example, in Japanese Laid-Open Patent Publication No. 95077/91, and comprises a document table for bearing documents; a feed means for feeding set documents placed on the document table; a document conveying means for conveying the document, fed by the feed means, onto a document exposure position; a document reversing means for reversing and conveying the document dispatched from the document conveying means; and a document discharge means having a discharge roller for discharging the document, sent by the document reversing means, onto the document table. In this recirculating automatic document feeder, the document discharge means is movable on the document table in the document conveying direction in accordance with the size of the document placed on the document table.

The automatic document feeder constructed in the above-described manner requires a drive means for driving the discharge roller disposed in the document discharge means, and houses an electric motor as a drive source in the document discharge means. When the electric motor as the drive source is disposed inside, a drive mechanism for transmittingly connecting together the electric motor and the discharge roller has a simple structure. However, the document discharge means itself is large in size, and its weight increases, so that the document discharge means is not entirely satisfactory as one to be constituted movably. Since the electric motor as the drive source is disposed in the mobile document discharge means, moreover, the wiring from the power source, disposed at a stationary place, to the electric motor is complicated.

With the thus constructed automatic document feeder, furthermore, a document discharge port of the document discharge means should be positioned above the document table by a predetermined amount. In the aforesaid prior art, the document conveyed by the document conveying means from the document exposure position after completion of exposure is transported to the document table by the document reversing means, whereafter the document sent to the document table is brought to a predetermined upper position by the document discharge means. By so constituting the apparatus, even when the document discharge means is moved in the document conveying direction in accordance with the size of the document placed on the document table, the document table serves as a guide of a document transport path. This gives the advantage that there is no need to provide a member forming a guide in conjunction with the movement of the document discharge means. However, the aforementioned prior art apparatus has a structure in which the document is conveyed to the document table by the document reversing means. Hence, the curvature of a reverse transport path constituting the document reversing means becomes small, posing the problem that the document is not conveyed smoothly. A way of increasing the curvature of the reverse transport path is to increase the height from the document conveying means to the document table. So doing would cause the problem of upsizing the entire automatic document feeder.

SUMMARY OF THE INVENTION

A first object of this invention is to provide an automatic document feeder equipped with a drive mechanism which has a drive source disposed at a stationary part and which can drive a discharge roller of a document discharge means constituted so as to be movable in the document conveying direction.

A second object of the invention is to provide an automatic document feeder which can increase the curvature of a reverse transport path without increasing the height from a document conveying means to a document table, and which can easily form a guide portion in response to the movement of the document discharge means.

To attain the first object, a first aspect of the present invention provides an automatic document feeder comprising a document table for bearing documents; a feed means for feeding the set documents placed on the document table; a document conveying means for conveying the document, fed by the feed means, to a document exposure position; a document reversing means for reversing and conveying the document dispatched from the document conveying means; and a document discharge means having a discharge roller for discharging the document, sent by the document reversing means, onto the document table, the document discharge means being adapted to be movable in the document conveying direction; which further comprises

- a drive pulley mounted on an end portion of the discharge roller;
- a pair of transmission pulleys disposed outside the moving range of the drive pulley in the document conveying direction, and rotatably supported at a stationary part;
- a timing belt looped between the pair of transmission pulleys and the drive pulley; and
- a drive source transmittingly connected to one of the pair of transmission pulleys and disposed at a stationary part.

To attain the second object, a second aspect of the present invention provides an automatic document feeder comprising a document table for bearing documents; a feed means for feeding the set documents placed on the document table; a document conveying means for conveying the document, fed by the feed means, to a document exposure position; a document reversing means for reversing and conveying the document dispatched from the document conveying means; and a document discharge means having a discharge roller for discharging the document, sent by the document reversing means, onto the document table, the document discharge means being adapted to be movable in the document conveying direction; wherein

- a reverse transport path constituting the document reversing means is formed so as to be curved and to have its send-out port positioned above the document table by a predetermined amount, and the document discharge means has a document guide means constituting a lower guide portion of a document transport path between the reverse transport path and the document discharge means in response to the movement thereof in the document conveying direction.

The present invention also provides an automatic document feeder in which the document guide means includes a flexible sheet member having one end attached to a roller support means for supporting the discharge roller, and a winding means having the other end of the sheet member attached thereto for winding up or winding off the sheet member.

Concretely, the winding means includes a winding roller disposed at a stationary part and having the other end of the sheet member attached thereto, and a winding roller actuating means for rotating the winding roller in response to the movement of the document discharge means.

More concretely, the winding roller actuating means includes a roller drive pulley mounted at an end portion of the winding roller and having the same diameter as that of the winding roller, a transmission pulley disposed with a predetermined spacing from the roller drive pulley in the document conveying direction, and a transmission belt looped between the roller drive pulley and the transmission pulley and connected to part of the document discharge means.

The present invention also provides an automatic document feeder in which the document guide means includes the flexible sheet member having one end attached to the roller support means for supporting the discharge roller, and a guide member for guiding the sheet member in response to the movement of the document discharge means.

Concretely, a weight member is provided at the other end portion of the sheet member. This weight member is preferably composed of a weight shaft, and rollers rotatably mounted on both end portions of the weight shaft.

The sheet member is preferably composed of a plastic sheet, and the plastic sheet, preferably, has been antistatically treated.

DETAILED DESCRIPTION OF THE PREFERRED EMBODIMENTS

Preferred embodiments of an automatic document feeder constructed in accordance with the present invention will be described in detail by reference to the accompanying drawings.

Figure 1:
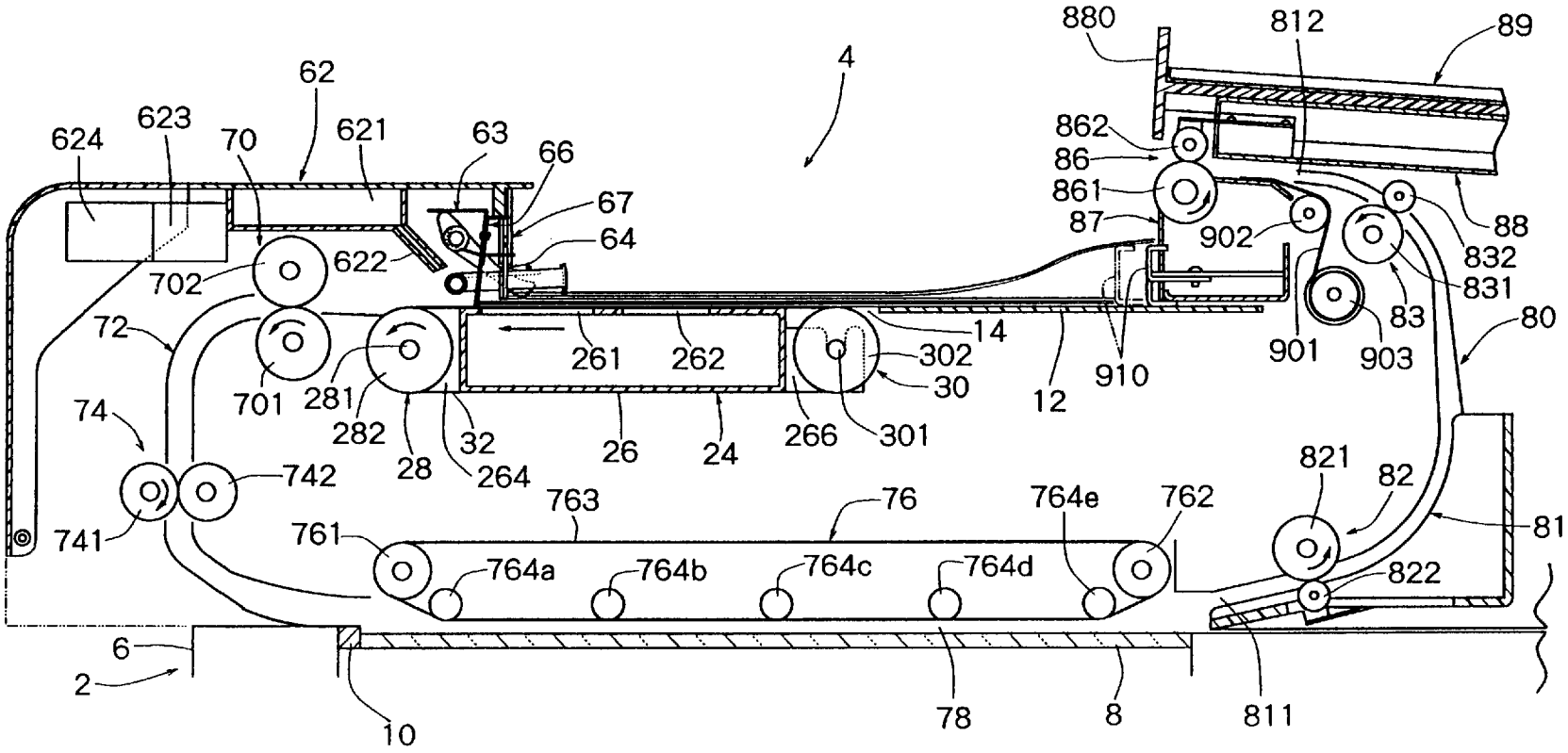
FIG. 1 is a sectional view of an automatic document feeder constructed in accordance with the present invention.

FIG. 1 illustrates an upper end portion of an electrostatic copying machine 2 and an automatic document feeder 4 mounted thereon. The electrostatic copying machine 2 has a housing 6, on top of which a transparent platen 8, optionally a glass plate, is disposed. On one side of the transparent platen 8 (the left-hand side in FIG. 1), a document restraining member 10 for determining a standard position for document setting is disposed. The automatic document feeder 4 constructed in accordance with the present invention is mounted on the top of the housing 6 of the electrostatic copying machine 2 so as to be pivotable about a pivot axis extending along a side edge on the far side of the transparent platen 8. If a document is to be laid manually on the transparent platen 8 of the electrostatic copying machine 2, the automatic document feeder 4 is pivoted upward from the illustrated closed position to the open position to expose the transparent platen 8 to the outside. Then, the document is placed at a required position on the transparent platen 8, and the automatic document feeder 4 is brought to the illustrated closed position to cover the transparent platen 8 and the document placed thereon. In laying the document on the transparent platen 8, one can set the document at the required position by contacting one edge of the document with the front edge of the document restraining member 10 to bring the one edge of the document to the standard position for document setting. When the automatic document feeder 4 is used to feed the document automatically onto the transparent platen 8 and force it automatically out from there, the automatic document feeder 4 is put to the closed position.

Figure 2:
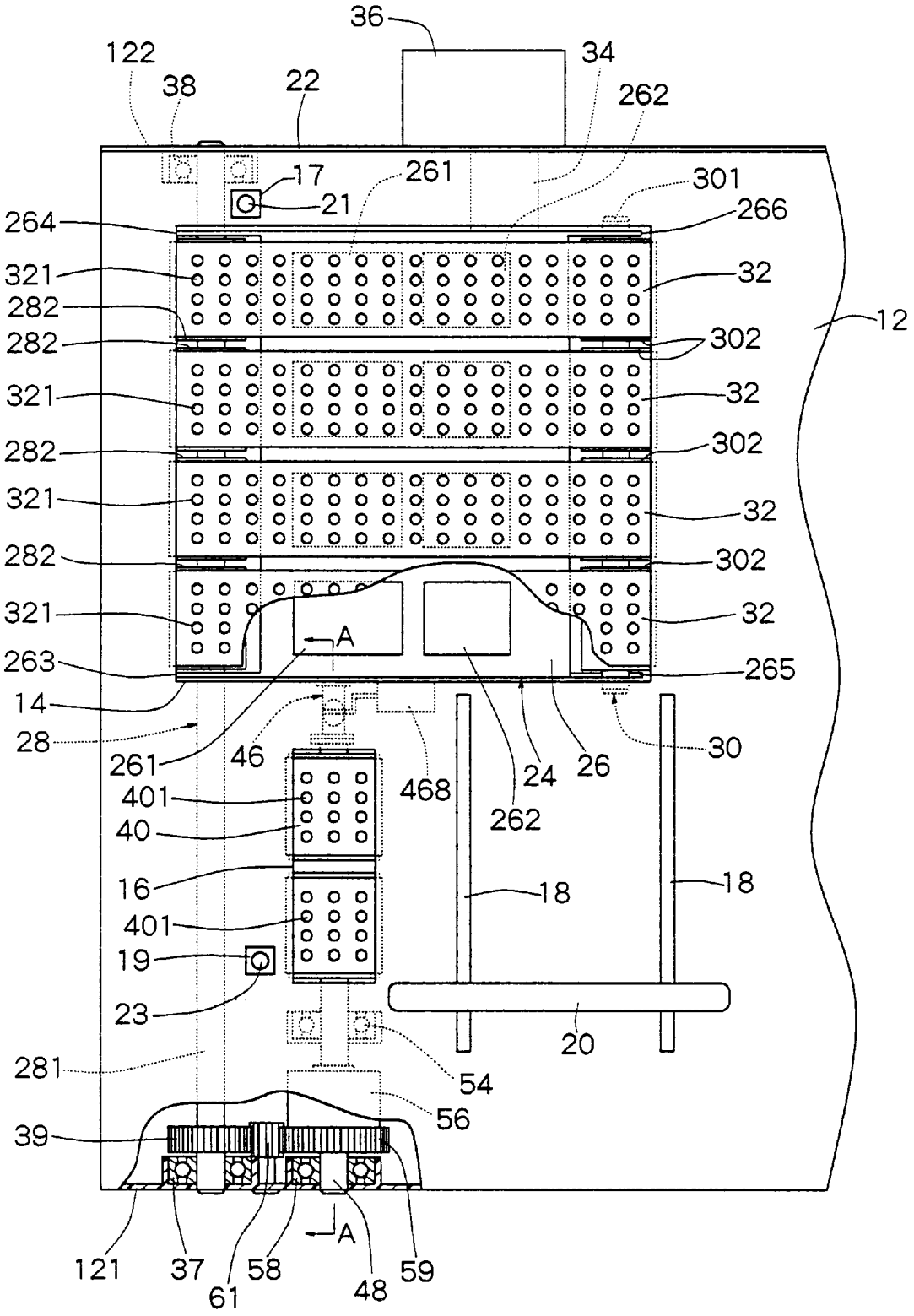
FIG. 2 is an essential part plan view, partly broken away, of a vacuum separating/feeding means mounted on the automatic document feeder shown in FIG. 1.

Further with reference to FIGS. 1 and 2, the illustrated automatic document feeder 4 includes a document table 12 as a document placing means disposed between opposite side plates 11 (only the side plate on the far side is indicated by a two-dot chain line in FIG. 1) arranged with spacing in a back-and-forth direction (the direction perpendicular to the sheet face in FIG. 1). The document table 12 has a large first opening 14 at a front part in the document conveying direction (the left-hand part in FIGS. 1 and 2) on the far side (the upper side in FIG. 2), and a second opening 16 smaller than the first opening 14 at a front part in the document conveying direction (the left side in FIG. 2) on the near and lateral side of the first opening 14. In the document table 12, a pair of guide grooves 18, 18 are provided which extend in the width direction behind the second opening 16 in the document conveying direction. The pair of guide grooves 18, 18 are fitted with support legs of a width regulating member 20 for regulating the widthwise position of the document placed on the document table 12. The width regulating member 20 is movable in the up-and-down direction in FIG. 2 along the pair of guide grooves 18, 18. In the automatic document feeder 4 of the illustrated embodiment, the standard position of the document placed on the document table 12 is on the far side (one side only). Thus, the widthwise position of the document placed on the document table 12 is regulated by the inner surface of a side plate 22 formed upright on the far side of the document table 12, and the inner surface of the width regulating member 20. On the far side in a front end part of the document table 12 in the document conveying direction, a sensor hole 17 is provided. Below the sensor hole 17, a reflection type first document detecting sensor 21 is disposed. This first document detecting sensor 21 detects the document placed on the document table 12, and sends a detection signal to a control means (not shown). In the document table 12, moreover, a sensor hole 19 is provided at a position corresponding to the forward side (the lower side in FIG. 2) of the second opening 16. On the lower side of the sensor hole 19, a reflection type second document detecting sensor 23 is disposed. The second document detecting sensor 23 serves as a document detecting means for detecting whether the widthwise size of the document placed on the document table 12 is larger than the size ranging from the inner surface of the side plate 22 to the second opening 16, namely whether the document placed on the document table 12 is situated on the second opening 16 or not. Then, the second document detecting sensor 23 delivers a detection signal to the control means (not shown). As a document detection signal on whether the document placed on the document table 12 is situated on the second opening 16 or not, there may be used a detection signal from a means which detects the size of the document based on the moving position of the width regulating member 20.

Below the document table 12, a vacuum separating/feeding means 24 is disposed in alignment with the first opening 14. The vacuum separating/feeding means 24 includes a vacuum chamber 26, a drive roller 28 and a driven roller 30 disposed parallel to each other ahead of and behind the vacuum chamber 26 in the document conveying direction, and four feed belts 32 passed over the drive roller 28, the driven roller 30 and the vacuum chamber 26. The vacuum chamber 26 is formed of a plastic material, and has in its upper wall four openings 261 forwardly in the document conveying direction, and four openings 262 behind the four openings 261 in the document conveying direction. The so constructed vacuum chamber 26 is attached to the lower surface of the document table 12 by a suitable support means (not shown) such that the upper surface of the vacuum chamber 26 will be nearly coplanar with the upper surface of the document table 12. The vacuum chamber 26 is connected to a suction blower 36 via a duct 34 connected to a hole (not shown) formed in the far-side wall thereof. The drive roller 28 is disposed through support walls 263 and 264 provided to protrude forward in the document conveying direction from the opposite side walls of the vacuum chamber 26. The drive roller 28 comprises a rotating shaft 281 having both end portions supported rotatably by bearings 37, 38 in support walls 121, 122 provided to protrude downwardly from the lower surface of the document table 12, and four rollers 282 disposed on the rotating shaft 281 in correspondence with the four openings 261 in the document conveying direction. On one end portion of the rotating shaft 281 of the so constructed drive roller 28, a roller drive gear 39 is mounted, and the roller drive gear 39 is transmittingly connected to a drive mechanism (not shown) so as to be rotationally driven in the direction of the arrow. The driven roller 30 comprises a shaft 301 supported by support walls 265 and 266 provided to protrude rearward in the document conveying direction from the opposite side walls of the vacuum chamber 26, and four rollers 302 disposed rotatably on the rotating shaft 301 in correspondence with the four openings 262 in the document conveying direction. The four feed belts 32 has a plurality of holes 321, and are wound round the respective rollers 282 and 302 of the drive roller 28 and the driven roller 30. The so constructed feed belts 32 are disposed such that their upper surfaces are located slightly above the upper surface of the document table 12.

Figure 3:
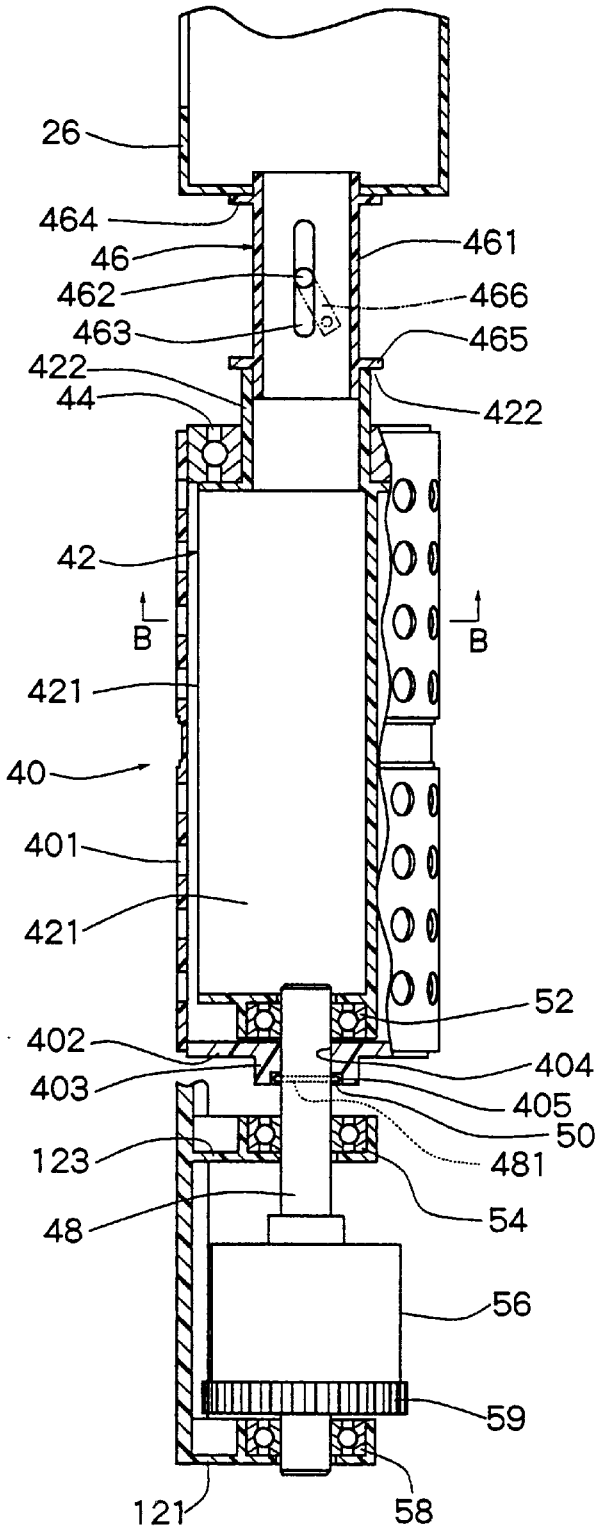
FIG. 3 is a sectional view taken on line A—A of the vacuum separating/feeding means shown in FIG. 2.
Figure 4:
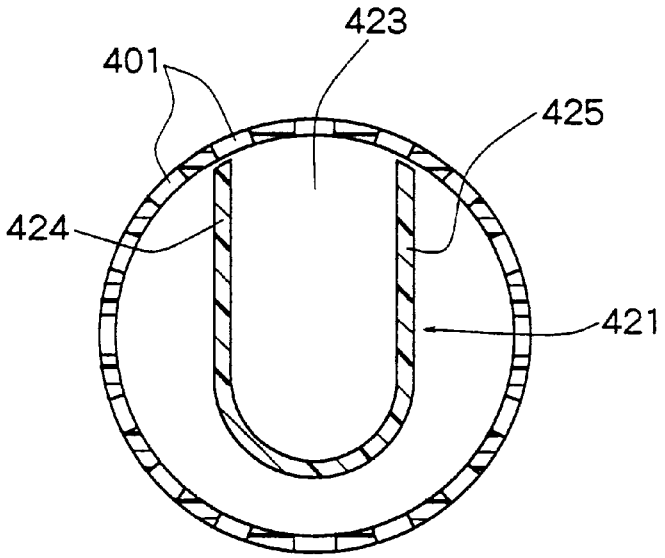
FIG. 4 is a sectional view taken on line B—B of the vacuum separating/feeding means shown in FIG. 3.

Below the document table 12, a feed drum 40 is disposed in correspondence with the second opening 16 as shown in FIG. 2. The feed drum 40, as shown in FIGS. 3 and 4, is formed of a plastic material, and has a plurality of holes 401 at the periphery. One end of the feed drum 40 is open, and a duct 42 for connection to the vacuum chamber 26 is inserted into this open end. The duct 42 comprises a suction portion 421 and a connecting portion 422. The suction portion 421 has an opening 423 as shown in FIG. 4. The opening 423 is formed such that only the upper side of the suction portion 421 is open in the axial direction. The upper end sides of side walls 424, 425 of the duct 42 forming the opening 423 are as close to the inner peripheral surface of the feed drum 40 as possible. Thus, each of the plurality of holes 401 formed in the feed drum 40 opposes the opening 423 of the duct 42 and communicates with the duct 42, only when these holes are positioned upwardly. A bearing 44 is disposed between one end portion on the suction portion 421 side of the connecting portion 422 constituting the duct 42 and one end portion of the feed drum 40, so that the feed drum 40 is rotatably supported with respect to the duct 42. Between the duct 42 and the vacuum chamber 26, there is disposed an on-off valve 46 constituting an opening-closing means for establishing or cutting off communication between the vacuum chamber 26 and the feed drum 40. The on-off valve 46 comprises a valve housing 461, and a butterfly valve 463 mounted on a valve shaft 462 mounted on the valve housing 461. One end portion of the valve housing 461 is inserted into and connected to the vacuum chamber 26 through a connecting hole 267 formed in a side wall of the vacuum chamber 26. On the outer periphery of the one end portion of the valve housing 461, a flange 464 is provided to restrict insertion into the vacuum chamber 26. The flange 464 is fixed to the side wall of the vacuum chamber 26 by a securing means such as a machine screw. The other end portion of the valve housing 461 is inserted into and connected to the other end portion of the connection portion 422 constituting the duct 42. On the outer periphery of the other end portion of the valve housing 461, a flange 465 is provided to restrict insertion into the duct 42. The so constructed on-off valve 46 has a lever 466 mounted on its valve shaft 462. The lever 466 is connected to a plunger of a solenoid 468 (see FIG. 2) via a link mechanism. The butterfly valve 463 actuated by the solenoid 468 is in a closed state when the solenoid 468 is deenergized, but is open when the solenoid 468 is energized. The solenoid 468 is deenergized when the second document detecting sensor 23 does not detect the document, and is energized by the control means (not shown) when the second document detecting sensor 23 detects the document.

An end wall 402 is provided at the other end of the feed drum 40. A boss 403 is formed at the center of the end wall 402, and a shaft fitting hole 404 and a pin fitting groove 405 are provided in the boss 403. An end portion of a rotating shaft 48 is fitted into the shaft fitting hole 404 provided in the boss 403 of the end wall 402 constituting the feed drum 40. The rotating shaft 48 has a pin insertion hole 481 passing diametrically through the shaft center. A pin 50 fitted into the pin insertion hole 481 is fitted in the pin fitting groove 405 formed in the boss 403, whereby a driving force of the rotating shaft 48 is transmitted to the feed drum 40. A bearing 52 is disposed between an end portion of the rotating shaft 48 inserted into the feed drum 40 and an end portion of the suction portion 421 constituting the duct 42, so that the other end portion of the duct 42 is supported rotatably relative to the one end portion of the rotating shaft 48. The rotating shaft 48 has an intermediate portion supported rotatably via a bearing 54 on a support wall 123 provided to protrude downwardly from the lower surface of the document table 12. The other end of the rotating shaft 48 is rotatably supported by a bearing 58 on the support wall 121. On the other end portion of the rotating shaft 48, a feed drum drive gear 59 is loosely fitted, and an electromagnetic clutch 56 is disposed for transmittingly connecting the feed drum drive gear 59 to the rotating shaft 48. Thus, when the electromagnetic clutch 56 is deenergized, the rotating shaft 48 and the feed drum drive gear 59 can make relative rotations, whereas when the electromagnetic clutch 56 is energized, the rotating shaft 48 and the feed drum drive gear 59 are transmittingly connected. The feed drum drive gear 59 is transmittingly connected to the roller drive gear 39 via an intermediate gear 61 as shown in FIG. 2. The numbers of the teeth of the intermediate gear 61 and the feed drum drive gear 59 as driving means for transmitting power from the roller drive gear 39 to the drive shaft 48 of the feed drum 40 are set such that the moving speed of the feed belts 32 actuated by the drive roller 28 of the vacuum separating/feeding means 24 is nearly equal to the peripheral speed of the feed drum 40. The electromagnetic clutch 56 is deenergized when the second document detecting sensor 23 does not detect the document, and is energized by the control means (not shown) when the second document detecting sensor 23 detects the document.

The vacuum separating/feeding means 24 has a separating air jetting means 62, called air knife, disposed above a front end part of the document table 12 in the document conveying direction. This separating air jetting means 62 comprises a pneumatic chamber 621, a nozzle 622 for jetting air in the pneumatic chamber 621 toward a front end part of the document set on the document table 12, a blower 623 for supplying air to the pneumatic chamber 621, and a servomotor 624 for driving the blower 623. In the illustrated embodiment, the servomotor 624 has a rotational speed adjusted by the control means (not shown) on the basis of a detection signal from a document load detecting means to be described later, namely, the load of the set documents placed on the document table 12. That is, when the load of the set documents is heavy, the rotational speed of the servomotor 624 is high. For a light load of the set documents, the rotational speed of the servomotor 624 is low. Thus, the blower 623 driven by the servomotor 624 has a rotational speed adjusted in response to the load of the documents, i.e., the weight of the documents set on the document table 12. Accordingly, the amount of air jetted from the nozzle 622 is adjusted in response to the weight of the documents on the document table 12. When air is jetted from the nozzle 622 of the so constructed separating air jetting means 62, air is injected between the documents laid on the document table 12, performing a document separating action.

A set document stopper 63 is disposed above a front end part of the vacuum separating/feeding means 24 in the document conveying direction. A discharged document stopper 64 is disposed upstream from the set document stopper 63 in the document conveying direction. Three each of the set document stoppers 63 and the discharged document stoppers 64 are disposed with spacing in the width direction (the direction perpendicular to the sheet face in FIGS. 1, 5 and 6; the right-and-left direction in FIG. 7) of the document table 12 according to the illustrated embodiment. These set document stoppers 63 and discharged document stoppers 64 are supported by support means 66 and 67, mounted on an upper wall 65 of a plastic material mounted at the upper ends of the opposite side plates 11, so as to be movable in the up-and-down direction. The set document stopper 63 is composed of a metal plate such as of stainless steel, and has an elongated hole 631 in an intermediate part thereof. An upper end part of the set document stopper 63 is bent to form an acted-on portion 632. The support means 66 supporting the set document stopper 63 comprises a mounting boss 661 integrally formed with the plastic upper wall 65 so as to protrude downwardly; and a support plate 663 comprising a metal plate mounted to the boss 661 by a machine screw 662. This support plate 663 has a hole 664 at a central part, and has at a lower end part guide portions 665, 665 bent nearly at right angles on both sides. The set document stopper 63 is supported by the so constructed support plate 663 so as to be movable in the up-and-down direction. That is, the set document stopper 63 is disposed between the guide portions 665, 665 of the support plate 663, a bolt 666 is inserted through the hole 664 of the support plate 663 and the elongated hole 631 of the set document stopper 63, and a nut 667 is screwed over the bolt 666. The set document stopper 63 so supported on the support means 66 is movable between a stop position (see FIG. 5) where the lower end of the set document stopper 63 contacts the upper surface of the document table 12, and a retreat position (see FIGS. 1 and 6) where the lower end of the set document stopper 63 retreats upwards from the upper surface of the document table 12 by several millimeters.

Figure 8:
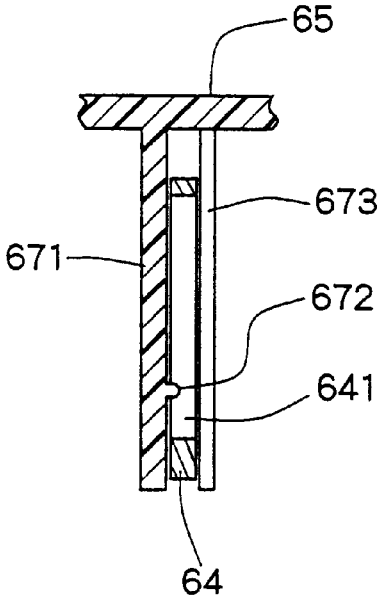
FIG. 8 is a sectional view taken on line C—C of FIG. 7.

Also, the discharged document stopper 64 is composed of a plastic material in the illustrated embodiment, and has an elongated hole 641 in its intermediate part, and acted-on protrusions 642, 642 on both sides of its upper end part. A support means 67 for supporting the discharged document stopper 64, on the other hand, has a support member 671 formed integrally with the upper wall 65 of a plastic material so as to protrude downwardly, and guide members 673, 673, as shown in FIG. 8. The support member 671 has a guide protrusion 672 at the center of its lower end part. The guide members 673, 673 are disposed with a predetermined spacing (a slightly larger spacing than the thickness of the discharged document stopper 64) from the support member 671 and at positions opposing both side parts of the support member 671. The discharged document stopper 64 is inserted between the support member 671 and the guide members 673, 673 of the so constructed support means 67. Then, the guide protrusion 672 provided on the support member 671 is fitted into the elongated hole 641 formed in the discharged document stopper 64, whereby the discharged document stopper 64 is supported by the support means 67 so as to be movable in the up-and-down direction. The discharged document stopper 64 so supported by the support means 67 is adapted to be movable between the restraint position (see FIGS. 1 and 6) where the discharged document stopper 64 contacts the set documents placed on the document table 12 and the retreat position (see FIG. 5) where it retreats upward of the document table 12. When the set documents are fed and decreased on the document table 12 with the discharged document stopper 64 being at the restraint position where it contacts the set documents placed on the document table 12, the discharged document stopper 64 goes down by its own weight following the decrease of the documents under the action of the elongated hole 641. Thus, the discharged document stopper 64 also functions as a means of preventing the floating of the set documents. The three discharged document stoppers 64 are supported independently by the three support means 67, so that if the set documents float, the respective discharged document stoppers 64 always contact the floating documents. Thus, the documents being discharged can be prevented from sinking below the discharged document stopper 64.

Figure 9:
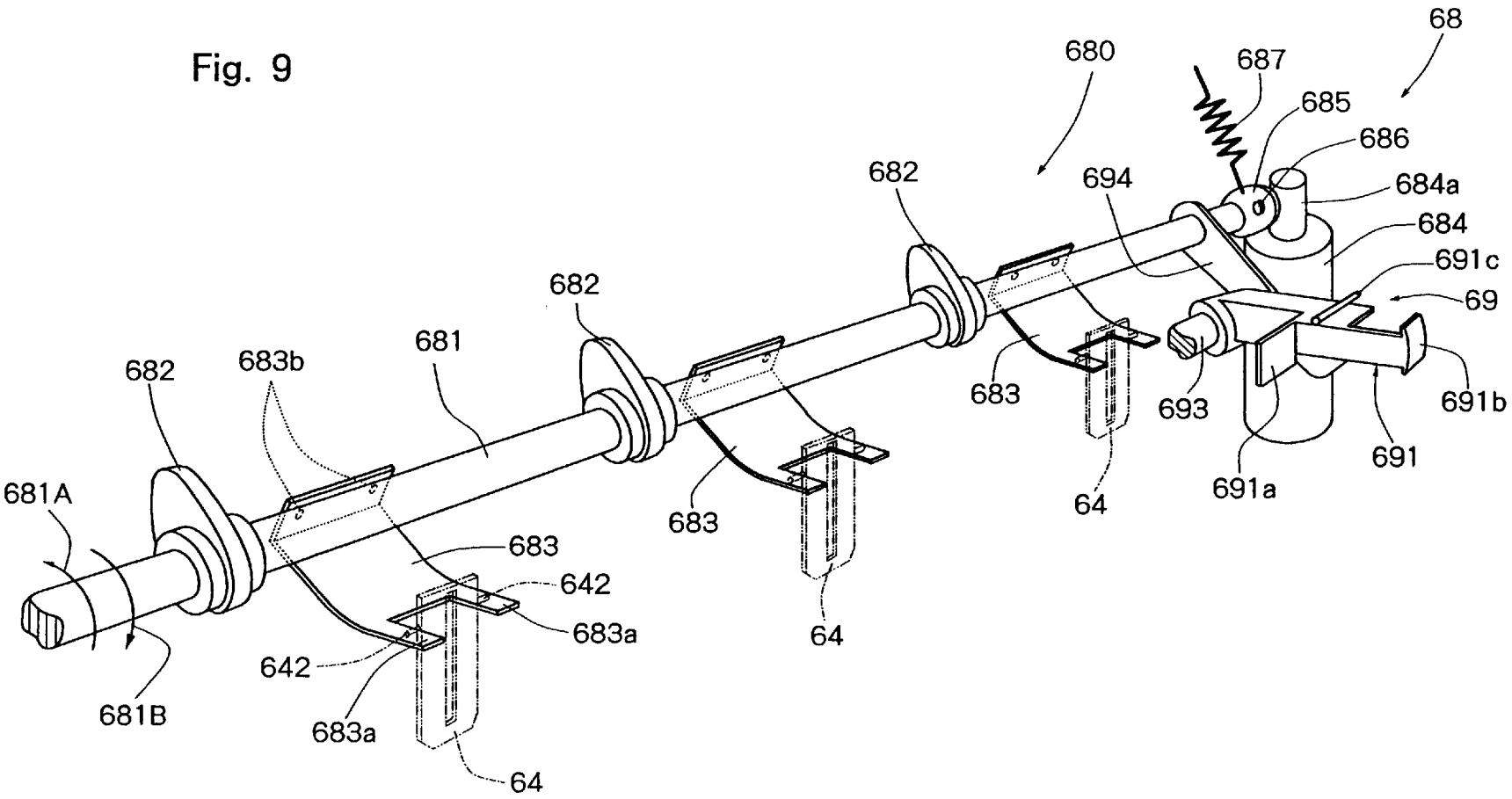
FIG. 9 is an essential part perspective view of a stopper moving means and a document load detecting means mounted on the automatic document feeder shown in FIG. 1.

Next, a stopper moving means 68 for bringing the set document stopper 63 and the discharged document stopper 64 to the predetermined positions will be described with reference to FIG. 9 as well. The stopper moving means 68 has a moving mechanism 680, and a single solenoid 684 as a means of driving the moving mechanism 680. The moving mechanism 680 constituting the stopper moving means 68 is disposed downstream from the set document stopper 63 in the document conveying direction, and has a moving shaft 681 rotatably supported by the opposite side plates 11. On the moving shaft 681, three moving cams 682 are mounted at positions corresponding to the set document stoppers 63, and three moving levers 683 are mounted at positions corresponding to the discharged document stoppers 64. The three moving cams 682 are disposed to contact the lower surfaces of the acted-on portions 632 of the three set document stoppers 63. The moving cams 682 are turned by the rotation of the moving shaft 681 to move the set document stoppers 63 to the stop position or the retreat position. The three moving levers 683 are constituted by a metal plate such as one of stainless steel. At one end of the moving lever 683, two moving pieces 683*a*, 683*a* are formed to protrude, while the other end of the moving lever 683 is attached to the moving shaft 681 by machine screws 683*b*, 683*b*. The two moving pieces 683*a*, 683*a* provided at the moving lever 683 define a distance between themselves, the distance being slightly greater than the width of the discharged document stopper 64. The discharged document stopper 64 is positioned between the two moving pieces, which are engaged with the acted-on protrusions 642, 642 provided on the discharged document stopper 64. Thus, the moving lever 683 is turned by the rotation of the moving shaft 681 to move the discharged document stopper 64 to the restraint position and the retreat position. The single solenoid 684 as a means of driving the stopper moving means 68 has its plunger 684*a* connected by a pin 686 to a lever 685 mounted at a far-side end part of the moving shaft 681, thereby to rotate the moving shaft 681 through a predetermined angle. To the lever 685 mounted on the moving shaft 681, there is fastened the other end of a return spring 687 whose one end is fastened to a stationary part such as the side plate. By the action of this return spring 687, the moving shaft 681 is urged to turn in the direction of an arrow 681A in FIG. 9. Thus, the moving shaft 681, the moving cam 682 mounted on the moving shaft 681, and the moving lever 683 are positioned in the state of FIG. 5 when the solenoid 684 is deenergized. That is, the base circle of the moving cam 682 contacts the lower surface of the acted-on portion 632 of the set document stopper 63, so that the set document stopper 63 is put to the stop position, and the moving lever 683 turns upward to bring the discharged document stopper 64 to the retreat position. When the solenoid 684 is energized from the state of FIG. 5, the moving shaft 681 is turned in the direction of an arrow 681B in FIG. 9 via the plunger 684*a* and the lever 685. Thus, the moving cam 682 and the moving lever 683 mounted on the moving shaft 681 are positioned in the state of FIGS. 1 and 6. That is, the set document stopper 63 is brought to the retreat position by the cam portion of the moving cam 682, and the moving lever 683 is turned downward to bring the discharged document stopper 64 to the restraint position. The stopper moving means 68 so moving the set document stopper and the discharged document stopper is constructed of the single solenoid 684 and the moving mechanism 680. Thus, the stopper moving means 68 can be produced for a low cost. Moreover, the moving mechanism 680 is constructed from a combination of the moving shaft 681, the moving cam 682 and the moving lever 683. Its structure is so compact that it can be easily disposed above the document table 12.

Figure 5:
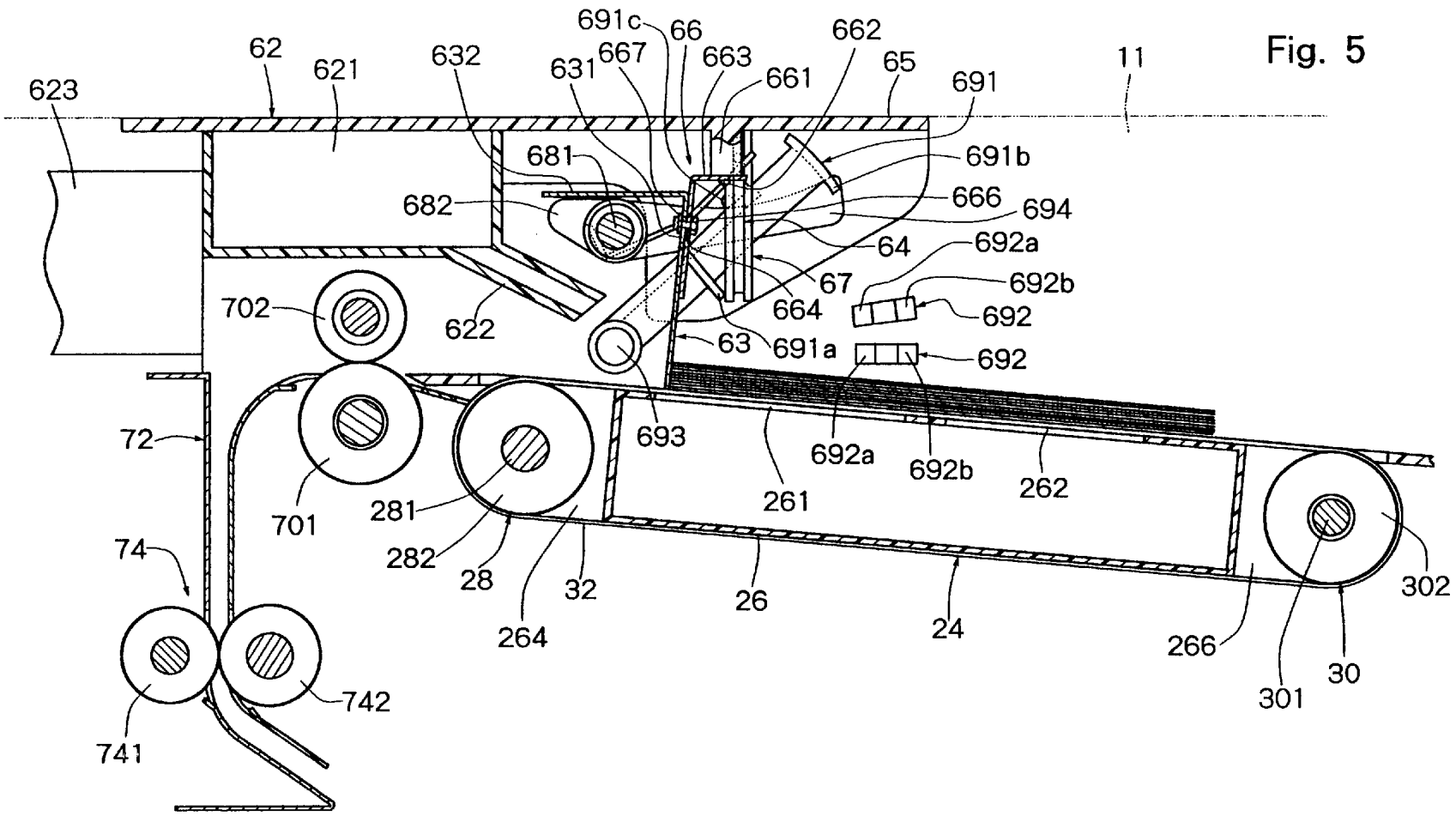
FIG. 5 is an essential part enlarged sectional view showing a state in which documents are set in the automatic document feeder shown in FIG. 1.
Figure 6:
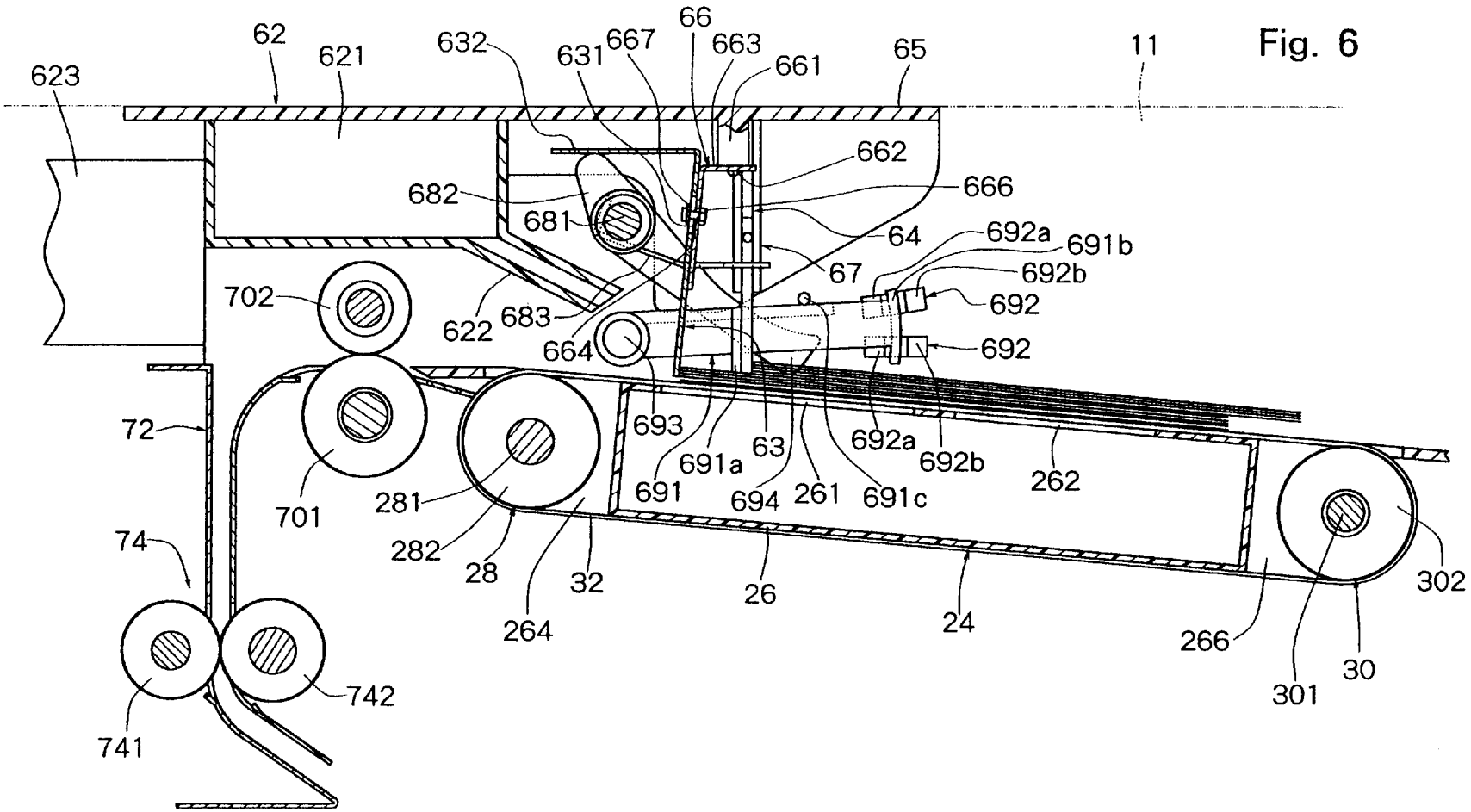
FIG. 6 is an essential part enlarged sectional view showing a state in which documents are conveyed in the automatic document feeder shown in FIG. 1.
Figure 7:
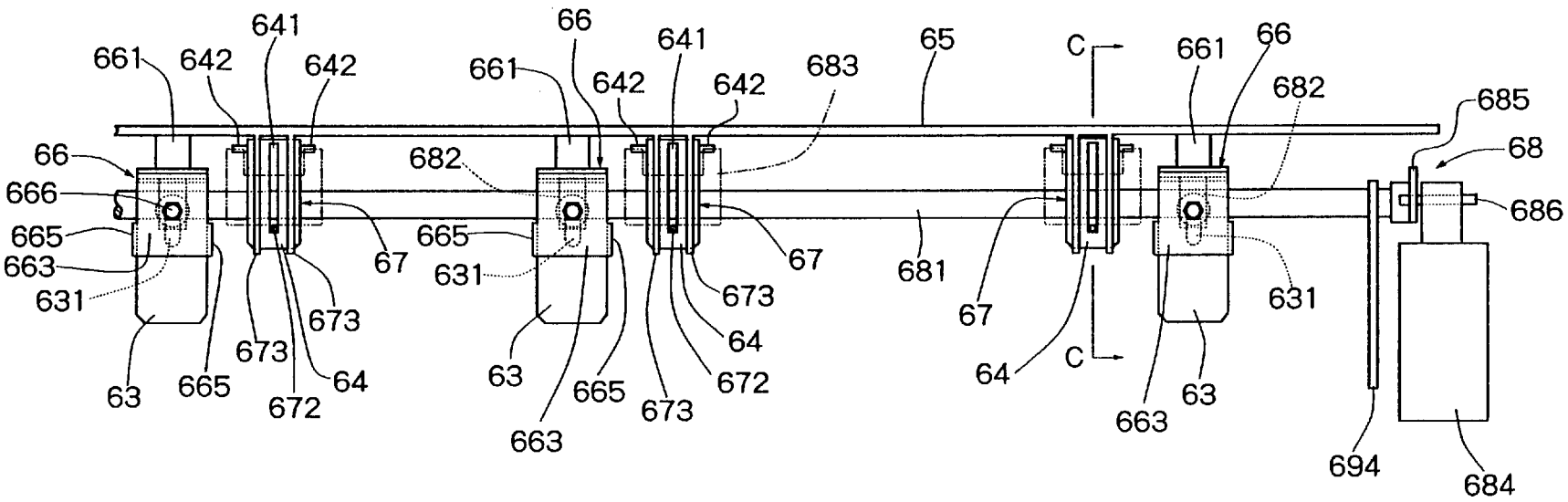
FIG. 7 is an essential part front view showing the relationship among a set document stopper, a discharged document stopper, and a stopper moving means mounted on the automatic document feeder shown in FIG. 1.

The illustrated automatic document feeder 4 has a document load detecting means 69 for detecting the load of the set documents placed on the document table 12. The document load detecting means 69 has a detector member 691 and two detectors 692, 692. The detector member 691 is composed of a plastic material, and has at an intermediate part a detector portion 691*a* which protrudes to the near side (toward the operator) and which is placed on the set documents on the document table 12. At one end of the detector member 691, there is provided a shield portion 691*b* which protrudes to the far side (away from the operator) and blocks light from the detector 692. At an intermediate part of the detector member 691, there is provided an acted-on protrusion 691*c* which protrudes to the far side and which the moving lever to be described later engages. The so constructed detector member 691 has the other end part thereof supported turnably on a short shaft 693 fixed to the side plate on the far side. In the illustrated embodiment, the detector portion 691*a* of the detector member 691 is positioned between the set document stopper 63 and the discharged document stopper 64 when placed on the set documents. Thus, the document returned onto the set documents after the set document has been fed does not contact the detector portion 691*a* of the detector member 691. The two detectors 692, 692 each have a light emitting element 692*a* and a light receiving element 692*b* as illustrated in FIGS. 5 and 6. These detectors 692, 692 are disposed, one above the other, and are attached to the far-side side plate. The two detectors 692, 692, and the shield portion 691*b* of the detector member 691 that moves between both elements can detect the altitudinal position of the detector portion 691*a*, i.e., the load of the set documents, in four states. The four states include the first state in which the load of the set documents is heavy and the shield portion 691*b* is located above the two detectors 692, 692; the second state in which the shield portion 691*b* blocks only the upper detector 692; the third state in which the shield portion 691*b* blocks the two detectors 692, 692; and the fourth state in which the shield portion 691*b* blocks only the lower detector 692. The stopper moving means 68 also has a moving lever 694 which engages the acted-on protrusion 691*c* of the detector member 691 constituting the document load detecting means 69 to move the detector portion 691*a* of the detector member 691 to the detection position and the retreat position. The moving lever 694 is mounted on the moving shaft 681 of the stopper moving means 68, and has its front part engaging the acted-on protrusion 691*c* of the detector member 691. That is, when the solenoid 684 is deenergized, the moving lever 694 turns the detector member 691 upward to bring it to the retreat position as shown in FIG. 5. When the solenoid 684 is energized from the state of FIG. 5, the moving lever 694 turns downward, whereupon the detector member 691 turns downward by its own weight and comes to the detection position where the detector portion 691*a* contacts the set documents.

With reference to FIG. 1, a feed roller pair 70 is disposed downstream from the document table 12 in the document conveying direction. The feed roller pair 70 consists of a drive roller 701 and a driven roller 702. The drive roller 701 is rotationally driven in the direction of the arrow by a drive mechanism (not shown). Downstream from the feed roller pair 70, a document send-in path 72 is disposed which guides the document fed by the feed roller pair 70 onto the transparent platen 8. On the document send-in path 72, a resist roller pair 74 is disposed. The resist roller pair 74 consists of a drive roller 741 and a driven roller 742, and the drive roller 741 is rotationally driven in the direction of the arrow by a drive mechanism (not shown).

A conveying belt mechanism 76 is disposed above the transparent platen 8. The conveying belt mechanism 76 constituting a document conveying means includes a drive roller 761 and a driven roller 762 disposed with spacing in the conveying direction of the transparent platen 8, an endless belt 763 wound between the drive roller 761 and the driven roller 762, and rollers 764*a*, 764*b*, 764*c*, 764*d*, 764*e* for rolling which are disposed between the drive roller 761 and the driven roller 762. The lower traveling portion of the endless belt 763 extends along the transparent platen 8 of the electrostatic copying machine 2, so that a document conveying path 78 is defined between the lower traveling portion and the transparent platen. The so constructed conveying belt mechanism 76 has the drive roller 761 rotationally driven by a drive mechanism (not shown).

On the right of the document conveying path 78 in FIG. 1, a document reversing means 80 is disposed. The document reversing means 80 includes a reverse transport path 81, and transport roller pairs 82 and 83 disposed on the reverse transport path 81. The reverse transport path 81 is formed in a smooth curve beginning at a send-in port 811, opposed to the document conveying path 78, and ending at a send-out port 812. The send-out port 812 is positioned above the document table 12 by a predetermined amount. The transport roller pairs 82 and 83 comprise drive rollers 821 and 831 and driven rollers 822 and 832, respectively, and each of these drive rollers 821 and 831 is rotationally driven in the direction of the arrow by a drive mechanism (not shown).

Downstream from the document reversing means 80, a document discharge means 85 is disposed. The document discharge means 85 will be described below with reference to FIGS. 10 to 17. The document discharge means 85 includes a discharge roller pair 86, a drive roller support means 87 for supporting a drive roller 861 constituting the discharge roller pair 86, a document guide member 88 disposed above the drive roller support means 87, and a cover member 89 disposed above the document guide member 88. The discharge roller pair 86 is constituted to have its nip portion positioned at nearly the same height as the send-out port 812 of the reverse transport path 81. The drive roller 861 constituting the discharge roller pair 86 is constituted by a rotating shaft 861*a* and a plurality of rollers 861*b* mounted on the rotating shaft 861*a*, and is rotatably supported by the drive roller support means 87. A far-side end portion of the rotating shaft 861*a* constituting the drive roller 861 is formed to protrude from the drive roller support means 87, and a drive pulley 861*c* is mounted on this protrusion (see FIG. 11).

Figure 11:
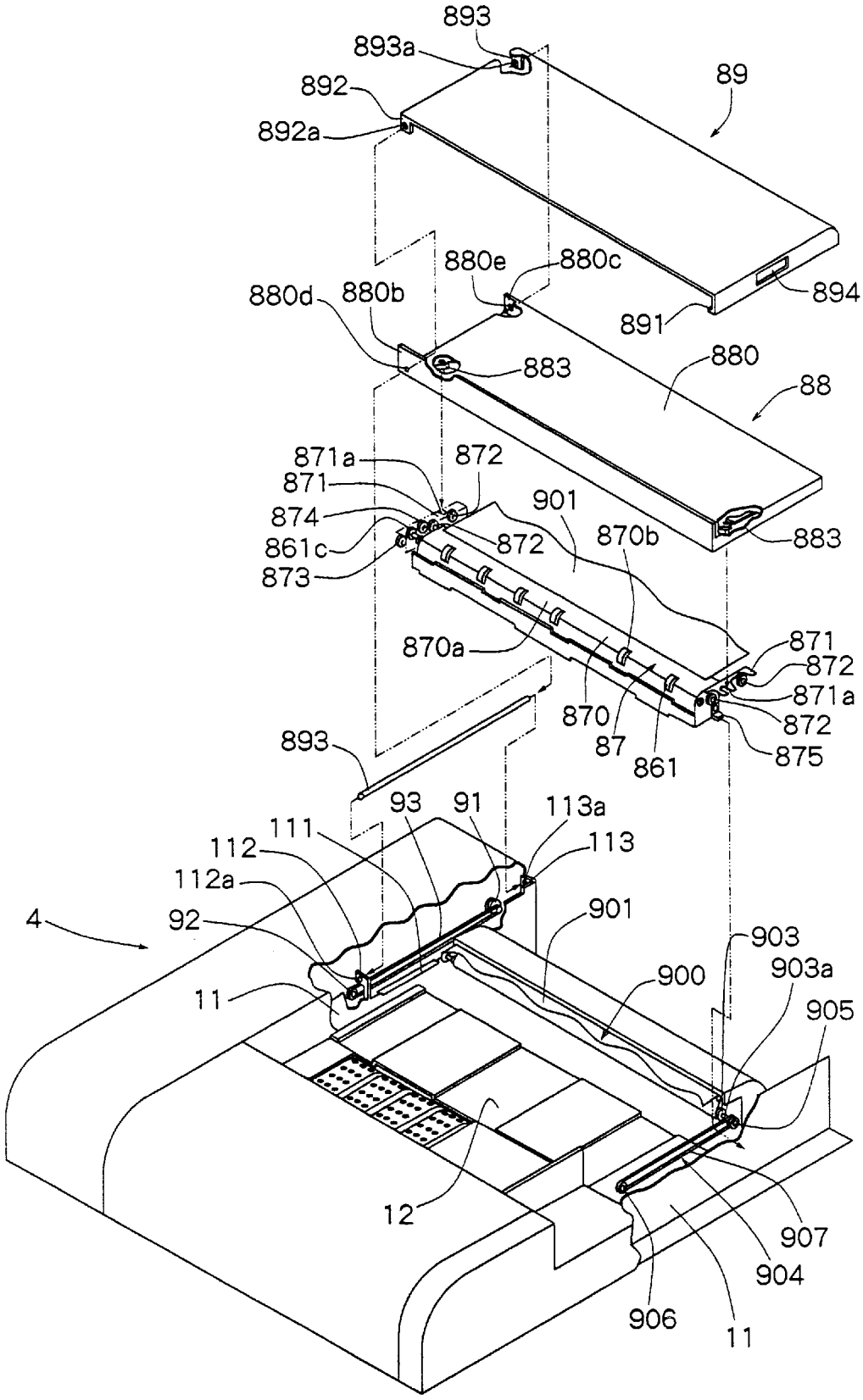
FIG. 11 is a perspective view showing, in an exploded manner, the document reversing means and the document discharge means of the automatic document feeder shown in FIG. 1.

In the illustrated embodiment, the drive roller support means 87 includes a support member 870 composed of two steel sheets having a nearly rectangular cross section. The support member 870 is constituted such that its top surface functions as a guide portion 870*a* for the document being discharged. In a downstream end portion of the guide portion 870*a* in the drive roller support means 87, a plurality of openings 870*b* are formed. The rollers 861*b* constituting the drive roller 861 are disposed such that their outer peripheral surfaces protrude from the top surface of the guide plate 870*a* through these openings 870*b*. At both ends of the drive roller support means 87, brackets 871, 871 having an L-shaped section are attached as shown in FIG. 11. On each of these brackets 871, 871, two support rollers 872, 872 are mounted so as to be placed on horizontal support rails 111, 111 (only the far-side rail 111 is shown in FIG. 11) attached to the side plates 11, 11. Thus, the drive roller support means 87 can move along the support rails 111, 111 in the document conveying direction. On the far-side bracket 871, there are mounted tension pulleys 873 and 874 on both sides of the drive pulley 861*c* mounted on the far-side end portion of the rotating shaft 861*a* constituting the drive roller 861 as shown in FIG. 11. On the near-side bracket 871, a connecting member 875 is mounted as shown in FIG. 11. The function of the connecting member 875 will be described later.

Figure 10:
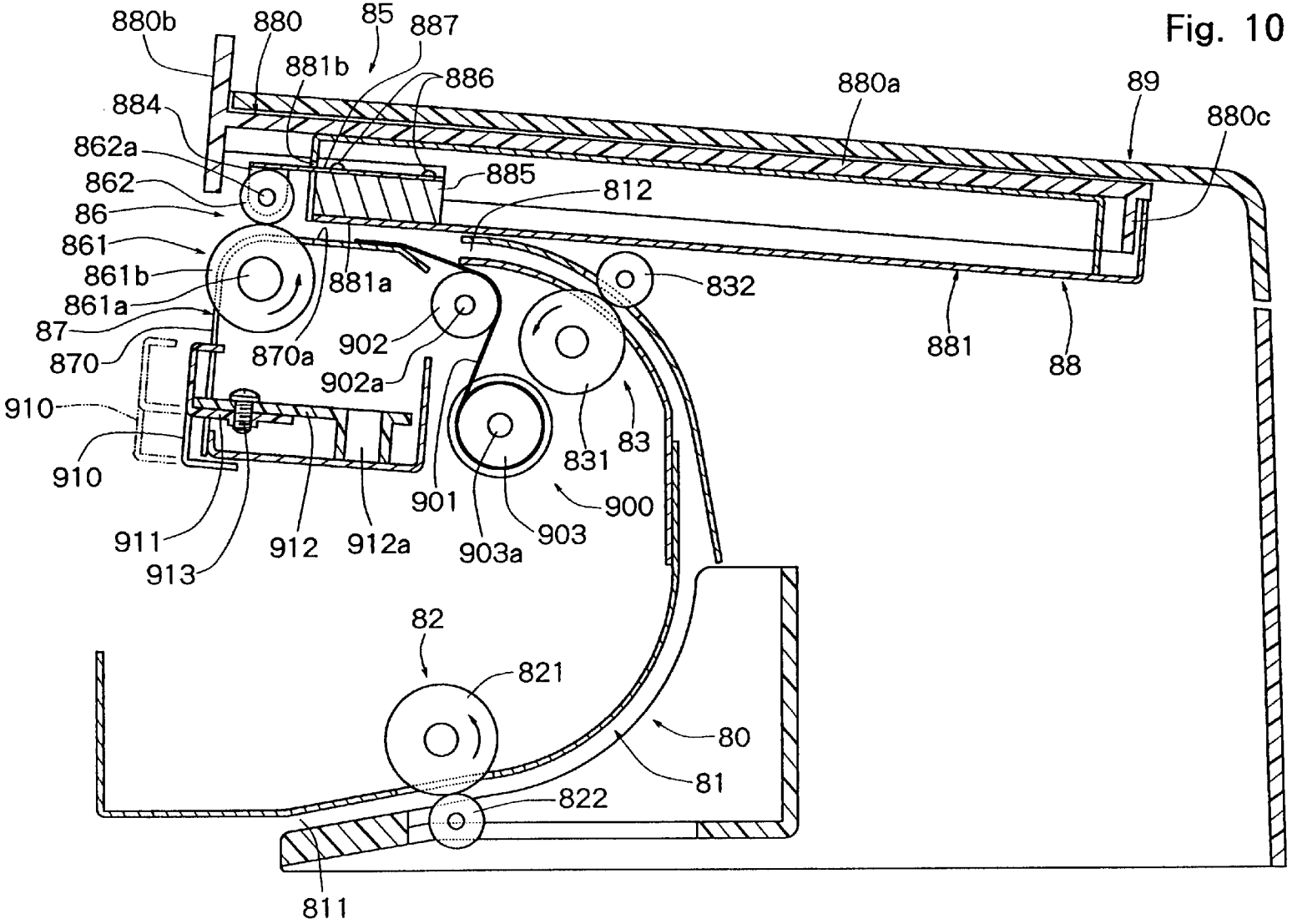
FIG. 10 is an enlarged sectional view of a document reversing means and a document discharge means in the automatic document feeder shown in FIG. 1.

The document guide member 88, as shown in FIGS. 10 and 11, includes a body member 880 formed of a plastic material, and a guide member 881 formed of a steel sheet bent in the shape of a box and mounted by a suitable securing means to the underside of the body member 880. The body member 880 is composed of a body portion 880*a*, a grip portion 880*b* provided at the front end in the document conveying direction of the body portion 880*a*, and a rear portion 880*c* provided at the rear end in the document conveying direction of the body portion 880*a*. The front portion 880*b* of the body member 880 is formed to protrude upwards and downwards from the body portion 880*a*, and has a rod insertion hole 880*d* bored in the lower far-side end part thereof. The rear portion 880*c* of the body member 880 is formed to protrude downwards from the body portion 880*a*, and has a rod insertion hole 880*e* bored in the far-side end part thereof. The underside of the guide member 881 constitutes an upper guide portion 881*a* which forms a nearly horizontal document transport path ranging from the downstream end portion of the reverse transport path 81 to the discharge roller pair 86 located at the document discharge site. To both end portions of the guide member 881, connecting pins 883, 883 are attached as shown in FIG. 11, and these connecting pins 883, 883 are to be fitted into fit grooves 871*a*, 871*a* formed in the brackets 871, 871 that constitute the drive roller support means 87. Thus, the fitting of the connecting pins 883, 883 into the fit grooves 871*a*, 871*a* enables the document guide member 88 to move the drive roller support means 87 integrally along the support rails 111, 111 in the document conveying direction. In the guide member 881 constituting the document guide member 88, a plurality of driven rollers 862 constituting the discharge roller pair 86 are disposed opposite the plurality of rollers 861*b* constituting the drive roller 861. The driven roller 862 has its rotating shaft 862*a* rotatably supported by support brackets 884, and the support brackets 884 are mounted to a roller support plate 887 which comprises spring steel and which has one end portion fixed by machine screws 886 to a mounting member 885 secured to the guide member 881. Thus, when the document guide member 88 is connected to the drive roller support means 87 as described above, the driven roller 862 is in pressed contact with the roller 861*b*, constituting the drive roller 861, by the spring force of the roller support plate 887. The roller support plate 887 is disposed through an opening 881*b* formed in a front end portion of the guide member 881.

The cover member 89 has a near-side end portion thereof bent downwards, and an engagement portion 891 is provided at the front end of the bend. This engagement portion 891 engages the near-side underside of the guide member 881 constituting the document guide member 88. The forward-side bend of the cover member 89 is provided with a hole 894 for insertion of the hand. A far-side end portion of the cover member 89 is provided with brackets 892 and 893 as shown in FIG. 11, and rod insertion holes 892*a*, 893*a* are formed in these brackets 892 and 893, respectively. A support guide rod 893 is inserted into the rod insertion holes 892*a*, 893*a* formed in the brackets 892, 893 as well as the rod insertion holes 880*d* and 880*e* formed in the grip portion 880*b* and rear portion 880*c* that constitute the document guide member 88. This support guide rod 895 is inserted, for fixing, into rod insertion holes 112*a* and 113*a* formed in the brackets 112 and 113 provided on the far-side side plate 11. When the support guide rod 895 is to be inserted for assembly, the bracket 892 provided forwards in the document conveying direction in the cover member 89 is positioned behind the front portion 880*b*, constituting the document guide member 88, in the document conveying direction, while the bracket 893 provided rearwards in the document conveying direction is positioned behind the rear portion 880*c*, constituting the document guide member 88, in the document conveying direction. Thus, when the upper end of the grip portion 880*b* constituting the document guide member 88 is gripped and pushed leftward from the state shown in FIG. 10, the document guide member 88 and the drive roller support means 87 can move leftward along the support rails 111, 111 while being guided by the support guide rod 895. Furthermore, when the hand is inserted into the hole 894 provided in the near-side bend of the cover member 89 to bring the cover member 89 upward from the state shown in FIG. 10, the cover member 89 is allowed to turn upward about the support guide rod 895. Upon this turn of the cover member 89, the engagement portion 891 provided in the near-side end portion of the cover member 89 engages the near-side undersurface of the guide plate 881 constituting the document guide member 88, whereby the document guide member 88 is also turned upward about the support guide rod 895. By thus upwardly turning the cover member 89 and the document guide member 88 about the support guide rod 895, the document discharge region can be opened. Should a jam occur in the document discharge region, therefore, the jammed document can be removed easily.

Figure 12:
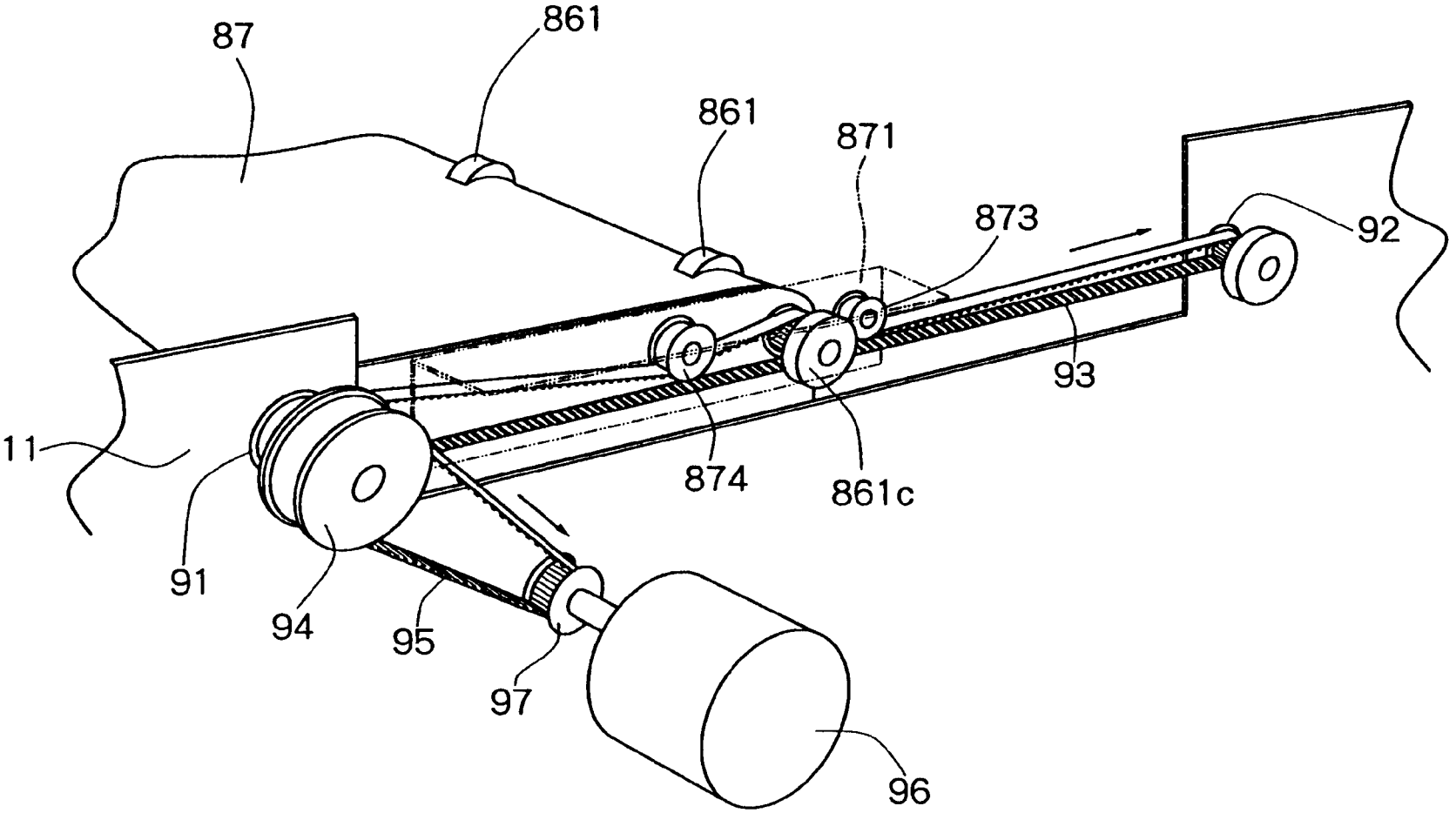
FIG. 12 is a perspective view showing a drive means for a discharge roller disposed in the document discharge means of the automatic document feeder shown in FIG. 1.

The drive means for the drive roller 861 constituting the discharge roller pair 86 rotatably supported by the drive roller support means 87 will be described with reference to FIG. 12. On the far-side side plate 11, the stationary part, a pair of transmission pulleys 91 and 92 are disposed outside of the moving range in the conveying direction of the drive pulley 861*c* mounted on the drive roller 861 outwardly of this side plate 11. An endless timing belt 93 is looped between the transmission pulleys 91 and 92 as well as the drive pulley 861*c* mounted on the rotating shaft 861*a* of the drive roller 861. Tension pulleys 873 and 874 disposed on both sides of the drive pulley 861*c* are adapted to press the top of the timing belt 93 as shown in FIG. 12. The transmission pulley 91 is transmittingly connected to a drive pulley 97 of an electric motor 96, disposed sideways relative to the side plate 11 as the stationary part, via a transmission pulley 94 disposed coaxially with the transmission pulley 91, and a timing belt 95 looped over the transmission pulley 94. Thus, when the electric motor 96 is driven, its driving force is transmitted to the drive pulley 97, timing belt 95, transmission pulley 94, transmission pulley 91, timing belt 93 and transmission pulley 92. As the timing belt 93 is actuated in the direction of the arrow in FIG. 12, the drive pulley 861*c* mounted on the rotating shaft 861*a* of the drive roller 861 is rotated in the direction of the arrow. When force is applied during stoppage of the electric motor 96 in order to move the drive roller support means 87 in the conveying direction, the drive pulley 861*c* and the tension pulleys 873, 874 move along the timing belt 93 while rotating, thus enabling the drive roller support means 87 to be moved over the range illustrated in FIG. 13 in the document conveying direction from the position shown in FIG. 10. In the drive means for the drive roller 861 in the illustrated embodiment, the electric motor 96 as the drive source is thus disposed laterally of the side plate 11 as the stationary part, meaning that the electric motor 96 is not provided in the document discharge means 85 containing the discharge roller pair 86. Hence, the document discharge means 85 can be downsized and made lightweight. Furthermore, the electric motor 96 as the drive source does not move when the drive roller support means 87 supporting the drive roller 861 of the discharge roller pair 86 is moved in the conveying direction. Thus, the wiring from the power source to the electric motor 96 is simple. In addition, the electric motor 96 as the drive source is disposed sideways relative to the side plate 11 as the stationary part. This arrangement enables the electric motor 96 to be used concurrently as a drive source for other devices, such as the transport roller pairs 82 and 83 of the document reversing means 80.

In the illustrated embodiment, a document guide means 900 is disposed in the document discharge region, as shown in FIGS. 10 and 11, in response to the movement of the drive roller support means 87 in the conveying direction. The document guide means 900 includes a guide sheet 901 comprising a flexible sheet member such as a plastic film, and a guide roller 902 for guiding the movement of the guide sheet 901, a winding roller 903 for winding up or winding off the guide sheet 901 from time to time, and a winding roller actuating means 904 for rotating the winding roller 903 in response to the movement in the conveying direction of the drive roller support means 87. The guide sheet 901 has nearly the same size as the widthwise dimension of the document transport path. One end of the guide sheet 901 is secured by an adhesive or the like to the top of the guide portion 870*a* of the support member 870 constituting the drive roller support means 87, while the other end of it is attached to the winding roller 903. The guide roller 902 has nearly the same lengthwise dimension as the widthwise dimension of the guide sheet 901, and its rotating shaft 902*a* is rotatably supported by the side plates 11, 11 as the stationary part. The winding roller 903 also has nearly the same lengthwise dimension as the guide roller 902, and its rotating shaft 903*a* is rotatably supported by the side plates 11, 11 as the stationary part.

The winding roller actuating means 904, as shown in FIG. 11, includes a roller drive pulley 905 mounted at a near-side end portion of the rotating shaft 903*a* of the winding roller 903 and having the same diameter as that of the winding roller 903, a transmission pulley 906 disposed downstream from the roller drive pulley 905 in the document conveying direction and rotatably supported by the near-side side plate 11, and a timing belt 907 looped between the roller drive pulley 905 and the transmission pulley 906. To the timing belt 907, the connecting member 875 is fixed by a suitable fixing means, the connecting member 875 being mounted on the bracket 871 attached to the near-side end of the drive roller support means 87. The roller drive pulley 905 and the transmission pulley 906 are disposed with a greater spacing than the maximum moving length of the winding roller actuating means 904. Since the winding roller actuating means 904 is constructed as described above, when the drive roller support means 87 is moved downstream in the document conveying direction, the timing belt 907 is also moved by the same amount as the amount of this movement, thus causing the winding roller 903 to rotate in correspondence with that amount of movement. As a result, the guide sheet 901 is delivered by an amount corresponding to the amount of movement of the drive roller support means 87. When the drive roller support means 87 is moved upstream in the document conveying direction, on the other hand, the timing belt 907 is also moved by the same amount as the amount of this movement, thus causing the winding roller 903 to rotate in correspondence with that amount of movement. As a result, the guide sheet 901 is wound up by an amount corresponding to the amount of movement of the drive roller support means 87. Thus, a nearly horizontal document transport path is defined by the guide member 881 and the guide sheet 901 in a space between the drive roller support means 87 and the downstream end of the reverse transport path 81 produced by the movement in the conveying direction of the drive roller support means 87. The guide sheet 901 forms the lower guide portion of this document transport path.

At a lower part of the drive roller support means 87, a push-out plate 910 adapted to be movable by a predetermined amount in the document conveying direction, i.e. in the right-and-left direction in FIG. 1, is disposed. The push-out plate 910 and a push-out plate drive means 930 for actuating the push-out plate 910 will be described below with reference to FIGS. 14 to 17.

The push-out plate 910 is formed of a steel plate, and has nearly the same widthwise length as the drive roller support means 87. The height of the push-out plate 910 is larger than the maximum load height of the documents, and the height from the top of the push-out plate 910 to the nip position of the discharge roller pair 87 is also greater than the maximum load height of the documents. At the middle of the push-out plate 910, two connecting pieces 911, 911 bent backward are provided. To the connecting pieces 911, 911, an actuating plate 912 is attached by machine screws 913, 913. The actuating plate 912 is provided with a pin fit groove 912*a* elongated in the widthwise direction. Both side parts of the actuating plate 912 are provided with supported portions 912*b*, 912*b*, which are placed on support portions 920*a*, 920*a* of guide support members 920, 920 attached to the support member 870 constituting the drive roller support means 87. The guide support members 920, 920 are provided with guide grooves 920*b*, 920*b*. Both end parts of the supported portions 912*b*, 912*b* are fitted into these guide grooves 920*b*, 920*b*, so that the supported portions 912*b*, 912*b* are movable while being guided in the conveying direction.

The push-out plate drive means 930 has an electric motor 931, as a drive source, disposed on the far side of the support member 870 constituting the drive roller support means 87. The electric motor 931 is mounted on a bracket 932 attached to the support member 870. A drive shaft 931*a* of the electric motor 931 is mounted with a worm 933, which meshes with a worm gear 934. The worm gear 934 is constituted integrally with a transmission gear 935. The worm gear 934 and transmission gear 935 are attached to the support member 870, and rotatably mounted on a support shaft 936. The transmission gear 935 is constituted upwardly and downwardly integrally with a drive pulley 937, and meshes with a transmission gear 938. The drive pulley 937 and the transmission gear 938 are rotatably mounted on a support shaft 939 attached to a support plate 940 secured to the support member 870. In a near-side portion of the support member 870 constituting the drive roller support means 87, a driven pulley 941 is disposed. The driven pulley 941 is rotatably mounted on a support shaft 942 attached to the support member 870 and the support plate 940. At the lower end of the driven pulley 941, a detection disk 943 is integrally provided for detecting the turning position of the driven pulley 941, namely, the moving position of the push-out plate 910. The detection disk 943 has a notch 943*a* at a part of the outer periphery thereof. Opposite the outer periphery of the detection disk 943, first and second detectors 944 and 945 are disposed at a phase angle of 180 degrees to each other. The first and second detectors 944 and 945 are each composed of a well known optical detector comprising a light emitting element and a light receiving element. At the center of the support plate 940 secured to the support member 870 constituting the drive roller support means 87, first and second pin actuating pulleys 946 and 947 are disposed. The first and second pin actuating pulleys 946 and 947 are rotatably mounted on support shafts 948 and 949 attached to the support plate 940. These first and second pin actuating pulleys 946 and 947 are mounted with actuating pins 950 and 951, respectively. These actuating pins 950 and 951 are fitted into pin fit grooves 912*a* formed in the actuating plate 912. Between the first pin actuating pulley 946 and the second pin actuating pulley 947, a tension pulley 952 is disposed. The tension pulley 952 is rotatably mounted on a support shaft 953 attached to the support plate 940. A timing belt 954 is looped over the drive pulley 937, driven pulley 941, and first and second pin actuating pulleys 946 and 947. Between the first pin actuating pulley 946 and the second pin actuating pulley 947, the tension pulley 952 is adapted to press the timing belt 954. The diameters of the drive pulley 937, driven pulley 941, and first and second pin actuating pulleys 946 and 947 are set to be equal in the illustrated embodiment.

Figure 15:
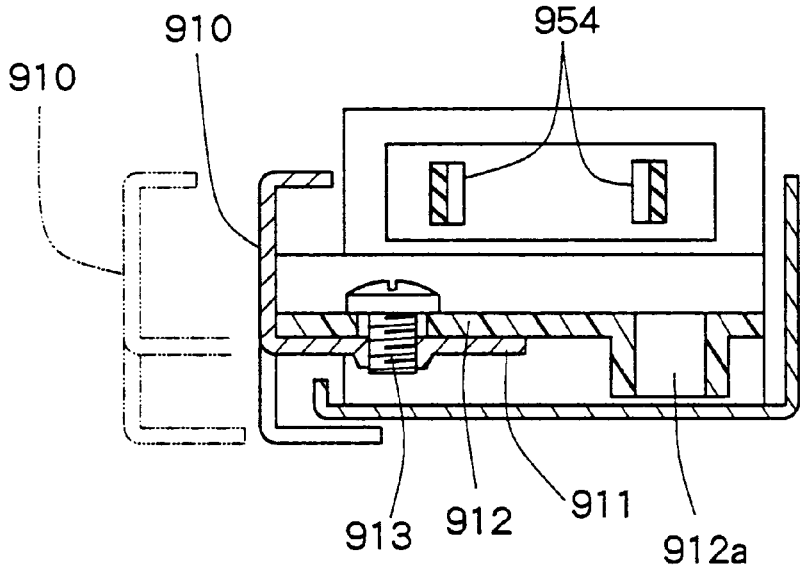
FIG. 15 is a sectional view taken on line D—D of FIG. 13.
Figure 17:
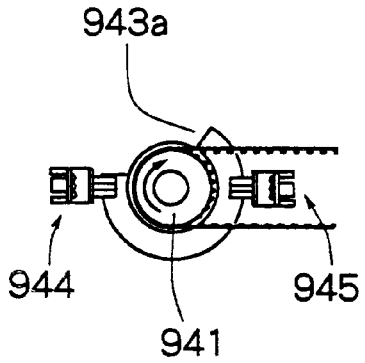
FIG. 17 is a plan view of a detection disk and a detector for detecting the position of movement of the push-out plate provided in the push-out plate drive means shown in FIG. 13.

The push-out plate drive means 930 constructed as described above acts in the following manner from the state indicated by solid lines in FIGS. 15 and 16: When the electric motor 931 is rotationally driven, its driving force is transmitted to the drive pulley 937 via the worm 933, worm gear 934, transmission gear 935 and transmission gear 938, whereby the drive pulley 937 is rotated in the direction of the arrow in FIG. 16. When the drive pulley 937 is rotated in the direction of the arrow in FIG. 16, the timing belt 954 is actuated in the direction of arrow in FIG. 16, whereupon the driven pulley 941 and first and second pin actuating pulleys 946 and 947 are rotated in the direction of the arrow in FIG. 16. Thus, by the action of the actuating pins 950 and 951 mounted on the first and second pin actuating pulleys 946 and 947, the actuating plate 912 is pushed out downstream in the document conveying direction. As a result, the push-out plate 910 having the actuating plate 912 mounted thereon is actuated downstream in the document conveying direction. When the first and second pin actuating pulleys 946 and 947 are rotated through 180 degrees from the state indicated by the solid line in FIG. 16, the push-out plate 910 is brought to a push-out position indicated by a two-dot chain line in the drawing. At this time, the electric motor 931 is stopped based on a detection signal from the first detector 944. That is, in the state illustrated in FIG. 16, the first and second detectors 944 and 945 are both shielded by the detection disk 943 and in the OFF state. When the detection disk 943 is rotated in the direction of the arrow from the state shown in FIG. 16, the first detector 944 becomes ON, since the notch 943*a* passes. Upon rotation of 180 degrees, the end part shielding the second detector 945 in FIG. 16 shields the first detector 944, as shown in FIG. 17, thereby turning it off. Based on this signal from the ON state to the OFF state of the first detector 944, the control means (not shown) stops the electric motor 931.

Figure 16:
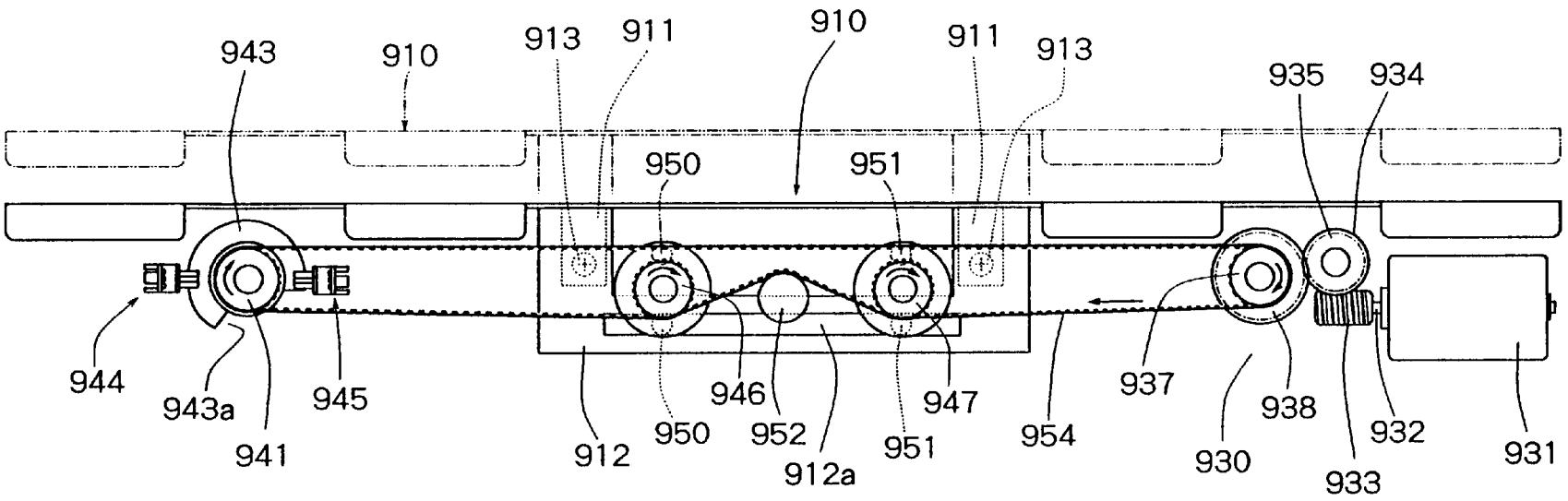
FIG. 16 is an essential part plan view of the push-out plate drive means shown in FIG. 14.

In returning the push-out plate 910 from the state indicated by the two-dot chain line to the position indicated by the solid line in FIG. 16, the following action will be performed: When the electric motor 931 is rotationally driven, the first and second pin actuating pulleys 946 and 947 are rotated in the direction of the arrow in FIG. 16 in the aforementioned manner. Thus, by the action of the actuating pins 950 and 951 mounted on the first and second pin actuating pulleys 946 and 947, the actuating plate 912 is pushed back upstream in the document conveying direction. As a result, the push-out plate 910 having the actuating plate 912 mounted thereon is actuated upstream in the document conveying direction. When the first and second pin actuating pulleys 946 and 947 are rotated through 180 degrees, the push-out plate 910 is brought to the position indicated by the solid line in the drawing. At this time, the electric motor 931 is stopped based on a detection signal from the second detector 945. That is, in the state illustrated in FIG. 17, the first and second detectors 944 and 945 are both shielded by the detection disk 943 and in the OFF state. When the detection disk 943 is rotated in the direction of the arrow from the state shown in FIG. 17, the second detector 945 becomes ON, since the notch 943*a* passes. Upon rotation of 180 degrees, the end part shielding the first detector 944 in FIG. 17 shields the second detector 945, as shown in FIG. 16, thereby turning it off. Based on this signal from the ON state to the OFF state of the second detector 945, the control means (not shown) stops the electric motor 931. The amount of movement in the conveying direction of the push-out plate 910 actuated as described above is set at an amount corresponding to the distance between the set document stopper 63 and the discharged document stopper 64.

The automatic document feeder according to the illustrated embodiment is constituted as described above. Its actions will follow.

Figure 13:
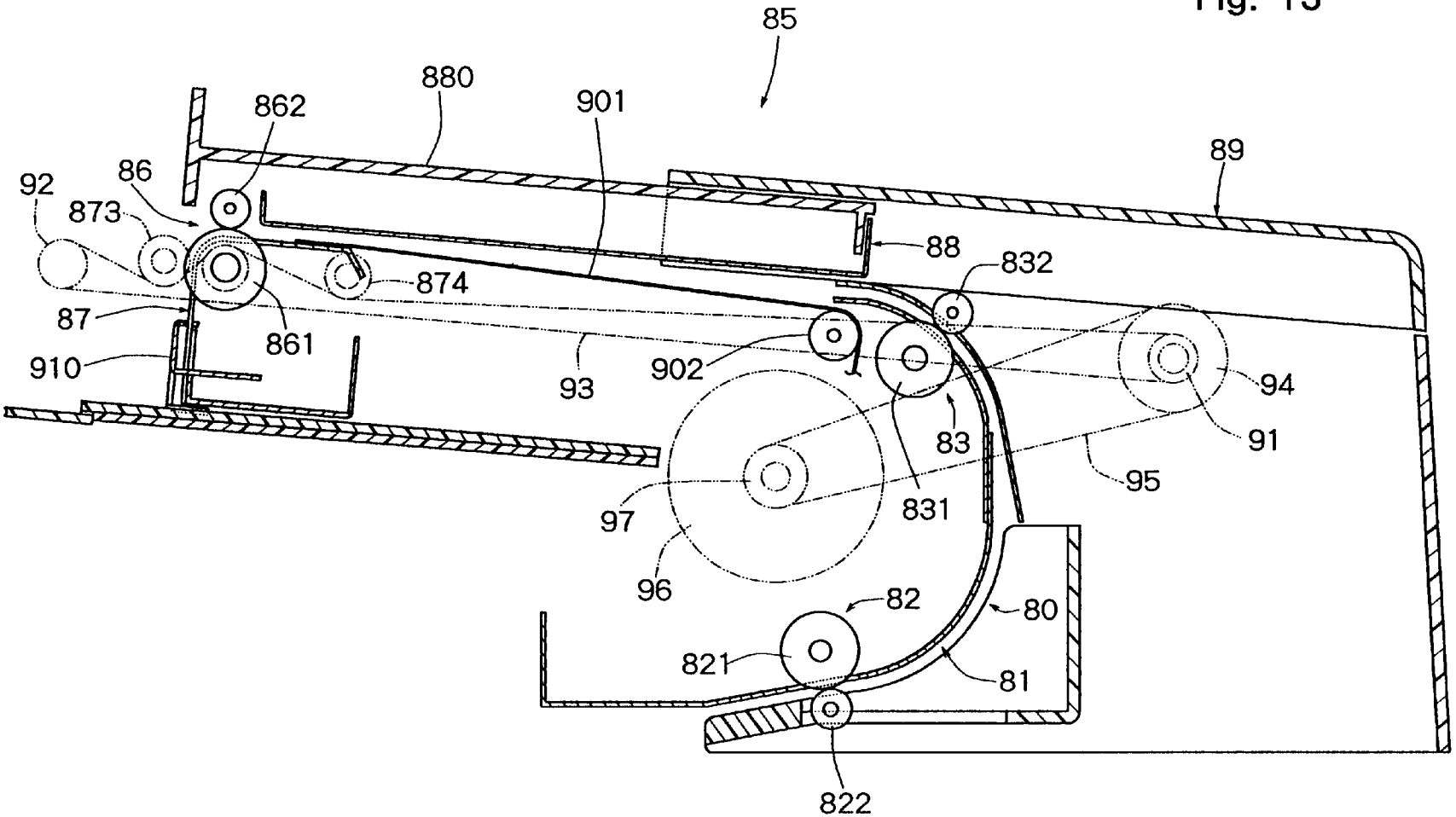
FIG. 13 is an essential part sectional view showing a state in which the document discharge means of the automatic document feeder shown in FIG. 1 has been moved in the document conveying direction.
Figure 14:
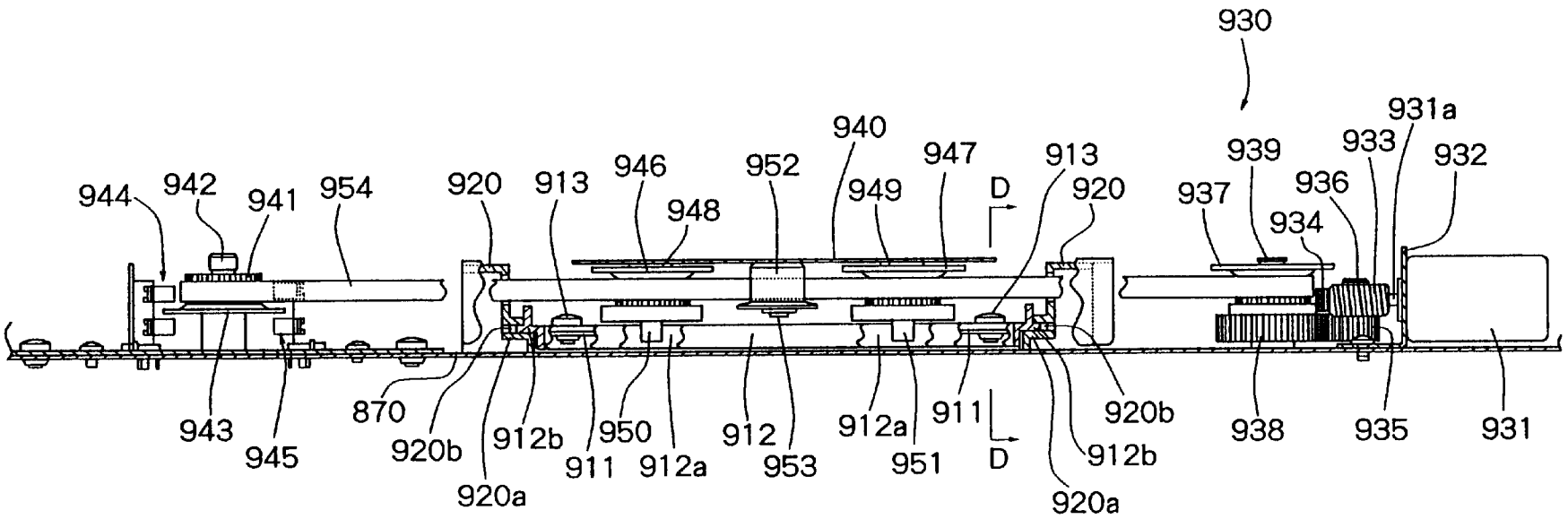
FIG. 14 is a sectional view of a push-out plate drive means for moving a push-out plate provided in the automatic document feeder shown in FIG. 1.

First, an explanation will be offered for the use of a document of a small width, such as the "A4" or "B5" size under the Japanese Industrial Standards (JIS). In setting documents on the document table 12, the solenoid 684 of the stopper moving means 68 is deenergized. Thus, the set document stopper 63 and the discharged document stopper 64 are positioned in the state of FIG. 5 in which the set document stopper 63 is brought to the stop position, and the discharged document stopper 64 is brought to the retreat position. The detector member 691 of the document load detecting means 69 is also put to the retreat position. Documents are placed on the document table 12 while being contacted with the set document stopper 63 whose front end is at the stop position. The width regulating member 20 is moved upward in FIG. 2, so that the widthwise position of the documents is regulated by the inner surface of the side plate 22 and the inner surface of the width regulating member 20. Then, the grip portion 880*b* of the document guide member 88 is gripped to move the drive roller support means 87 downstream in the document conveying direction from the state shown in FIGS. 1 and 10 to a position in correspondence with the size of documents placed on the document table 12, as shown in FIG. 13. The top of the document table 12 designates the position where the push-out plate 910 mounted on the drive roller support means 87 should be located in accordance with the size of the document. This position of location of the push-out plate 910 corresponds to the rear end position of the document when the document is discharged onto the document table 12 with the discharged document stopper 64 being located at the restraint position. When documents of a small width are set on the document table 12 as described above, the near-side (the side near to the operator) edge of the document, i.e., the lower side edge of the document in FIG. 2, does not reach the second opening 16. When the documents are set on the document table 12 in this fashion, the first document detecting sensor 21 detects that the documents have been set on the document table 12. This detection signal is sent to the control means (not shown). When a copy start switch (not shown) is depressed in this state, the electric motor 931 for the push-out plate actuating means 930 is rotationally driven by the control means (not shown) to bring the push-out plate 910 to the push-out position indicated by the two-dot chain line in FIGS. 1 and 10. Thus, documents placed on the document table 12 are pushed out to a set position where the front ends of the documents contact the set document stopper 63. When the documents placed on the document table 12 are moved to the set position this way, the solenoid 684 of the stopper moving means 68 is energized by the control means (not shown). As a result, the set document stopper 63 and the discharged document stopper 64 are positioned in the state of FIGS. 1 and 5 in which the set document stopper 63 is brought to the retreat position, and the discharged document stopper 64 is brought to the restraint position. The detector member 691 of the document load detecting means 69 is also put to the detection position. By the action of the control means (not shown), a copy action is started, and the suction blower 36 is driven to suck air in the vacuum chamber 26. Thus, of the documents placed on the document table 12, the bottom-most document is suction-attached to the feed belt 32 of the vacuum separating/feeding means 24. On this occasion, the servo-motor 624 of the separating air jetting means 62 is driven to actuate the blower 623, so that air is jetted through the nozzle 622 toward the front ends of the documents placed on the document table 12. Thus, air is injected between the documents placed on the document table 12, whereby the respective documents are separated. Thus, the bottom-most document is separated and suction-attached to the feed belt 32. On this occasion, the rear ends of the documents placed on the document table 12 are in contact with the push-out plate 910 located at the push-out position. Thus, the documents are not flown by air ejected from the nozzle 622 of the separating air jetting means 62. When the copy start switch is depressed, the drive roller 28 is rotationally driven in the direction of the arrow by the drive mechanism (not shown) via the roller drive gear 39. Upon rotation of the drive roller 28, the feed belt 32 is moved in the direction shown by the arrow. Thus, the bottom-most document suction-attached to the feed belt 32 as described above is fed downstream in the conveying direction. If the document with a small widthwise dimension is used, the second document detecting sensor 23 does not detect the document, and the solenoid 468 remains deenergized. Thus, the on-off valve 46 is closed, thereby cutting off communication between the vacuum chamber 26 and the feed drum 40. When the second document detecting sensor 23 does not detect the document, the electromagnetic clutch 56 is also deenergized, so that the feed drum 40 is also stopped.

The document so fed by the vacuum separating/feeding means 24 is delivered to the document send-in path 72 by the feed roller pair 70. Thus, its front end is brought into contact with the nip site of the resist roller pair 74 put in a nonoperating state, whereupon primary feeding is completed. Then, the resist roller pair 74 is actuated to deliver the document fed until the nip site toward the document conveying path 78 extending along the transparent platen 8 of the electrostatic copying machine 2. Further, the document is conveyed from left to right in FIG. 2 on the transparent platen 8 by the conveying belt mechanism 76 constituting the conveying means. The document is thereby positioned at a predetermined position, whereupon secondary feeding is completed. In this state, an exposure action is performed.

When an exposure action on the document positioned on the transparent platen 8 is finished, the conveying belt mechanism 76 is actuated to deliver the document on the transparent platen 8 toward the reverse transport path 81 of the document reversing means 80. The document delivered to the reverse transport path 81 is delivered toward the discharge roller pair 86 by the transport roller pairs 82 and 83. Past the discharge roller pair 86, the document is conveyed onto the set documents placed on the document table 12. The document conveyed by the transport roller pair 83 toward the discharge roller pair 86 has its face guided by the guide portion 881*a* of the guide member 881 constituting the document guide member 88, and has its back guided by the guide sheet 901 of the document guide means 900. The front end of the document sent in this manner onto the set documents placed on the document table 12 contacts the discharged document stopper 64, whereupon this document is distinguished from the initially set documents. A rear end part of the document discharged onto the document table 12 is supported on the push-out plate 910 positioned at the two-dot chain line in FIG. 1. In this manner, all of the set documents placed on the document table 12 are fed and returned onto the document table 12 after exposure action. In this case, the solenoid 684 of the stopper moving means 68 is deenergized by the control means (not shown), whereupon the set document stopper 63, the discharged document stopper 64 and the detector member 691 of the document load detecting means 69 are brought into the state of FIG. 5 in which the set document stopper 63 is brought to the stop position, the discharged document stopper 64 to the retreat position, and the detector member 691 of the document load detecting means 69 to the retreat position. The electric motor 931 of the push-out plate drive means 930 is rotationally driven by the control means (not shown) to bring the push-out plate 910 to the receding position indicated by the solid line in FIGS. 1 and 10. According to this movement of the push-out plate 910 to the receding position indicated by the solid line, the rear end parts of the documents discharged onto the document table 12 and supported on the push-out plate 910 are dropped onto the document table 12. If the documents discharged onto the document table 12 are to be copied again, the push-out plate 910 is moved to the push-out position indicated by the two-dot chain line in FIGS. 1 and 10. As a result, the documents returned onto the document table 12 are pushed leftward in the drawing by the push-out plate 910, and their front ends are brought into contact with the set document stopper 63 for resetting.

Next, an explanation will be offered for the use of a document of a large width, such as the JIS "A3" or "B4" size. In setting documents on the document table 12, the solenoid 684 of the stopper moving means 68 is deenergized. The set document stopper 63, the discharged document stopper 64, and the detector member 691 of the document load detecting means 69 are positioned in the state of FIG. 5 in which the set document stopper 63 is brought to the stop position, the discharged document stopper 64 to the retreat position, and the detector member 691 of the document load detecting means 69 is also put to the retreat position. In this state, the width regulating member 20 is moved to the operator side relative to the second opening 16, namely, downward in FIG. 2. Then, documents to be copied are placed on the document table 12, and the width regulating member 20 is moved upward in FIG. 2, whereupon the widthwise position of the documents is regulated by the inner surface of the side plate 22 and the inner surface of the width regulating member 20. When documents of a large width are set on the document table 12 as described above, the documents are placed across the first opening 14 and the second opening 16. When the documents are set on the document table 12 in this fashion, the first document detecting sensor 21 and the second document detecting sensor 23 detect that the documents have been set on the document table 12. This detection signal is sent to the control means (not shown). Then, the grip portion 880*b* of the document guide member 88 is held to move the drive roller support means 87 downstream in the document conveying direction from the state shown in FIGS. 1 and 10 to a position corresponding to the size of the documents placed on the document table 12. When the document placed on the document table 12 is of the B4 size, the document guide member 88 and the drive roller support means 87 are moved to a predetermined position. When the document is of the A3 size, on the other hand, the state of FIGS. 1 and 10 may be kept as such. When a copy start switch (not shown) is depressed in this state, the electric motor 931 of the push-out plate drive means 930 is rotationally driven by the control means (not shown) to bring the push-out plate 910 to the push-out position indicated by the two-dot chain line in FIGS. 1 and 10. Thus, the document placed on the document table 12 is pushed out to the set position where its front end contacts the set document stopper 63. Upon the movement of the document placed on the document table 12 to the set position, the solenoid 684 of the stopper moving means 68 is energized by the control means (not shown). As a result, the set document stopper 63 and the discharged document stopper 64 are positioned in the state of FIGS. 1 and 5 in which the set document stopper 63 is brought to the retreat position, and the discharged document stopper 64 to the restraint position. Also, the detector member 691 of the document load detecting means 69 is brought to the detection position. Simultaneously, a copy action is started by the control means (not shown), and the suction blower 36 is driven to suck air accommodated in the vacuum chamber 26. Thus, the bottom-most document of the documents placed on the document table 12 is suction-attached to the feed belts 32 of the vacuum separating/feeding means 24. On this occasion, the servomotor 624 of the separating air jetting means 62 is driven to actuate the blower 623, so that air is jetted through the nozzle 622 toward the front ends of the documents placed on the document table 12. Thus, air is injected between the documents placed on the document table 12, whereby the respective documents are separated, and the bottom-most document is separated. When a copy start switch is thrown, the drive roller 28 is rotationally driven in the direction of the arrow by the drive mechanism (not shown) via the roller drive gear 39. Upon rotation of the drive roller 28, the feed belts 32 are actuated in the direction of the arrow. In addition, when the second document detecting sensor 23 detects the document, the feed drum 40 is rotated, since the electromagnetic clutch 56 is energized. Thus, the bottom-most document suction-attached to the feed belts 32 and the feed drum 40 is fed to the downstream side in the conveying direction. When documents of a large widthwise dimension are placed on the document table 12, that is, when the second document detecting sensor 23 detects the documents, the feed drum 40 disposed beside the vacuum separating/feeding means 24 is actuated. The vacuum separating/feeding means 24 and the feed drum 40 feed the bottom-most document while sucking it in its entire widthwise direction. Hence, skew feed of the document is prevented reliably. In the illustrated embodiment, when documents of a small width are placed on the document table 12, that is, when the second document detecting sensor 23 detects no documents, the solenoid 468 is deenergized, and the on-off valve 46 is closed. Thus, the degree of vacuum within the vacuum chamber 26 of the vacuum separating/feeding means 24 does not lower. Also, in the illustrated embodiment, when the second document detecting sensor 23 detects no documents, the electromagnetic clutch 56 is deenergized, and the feed drum 40 stops. Since the feed drum 40 does not rotate without bearing documents thereon, safety can be secured.

Figure 18:
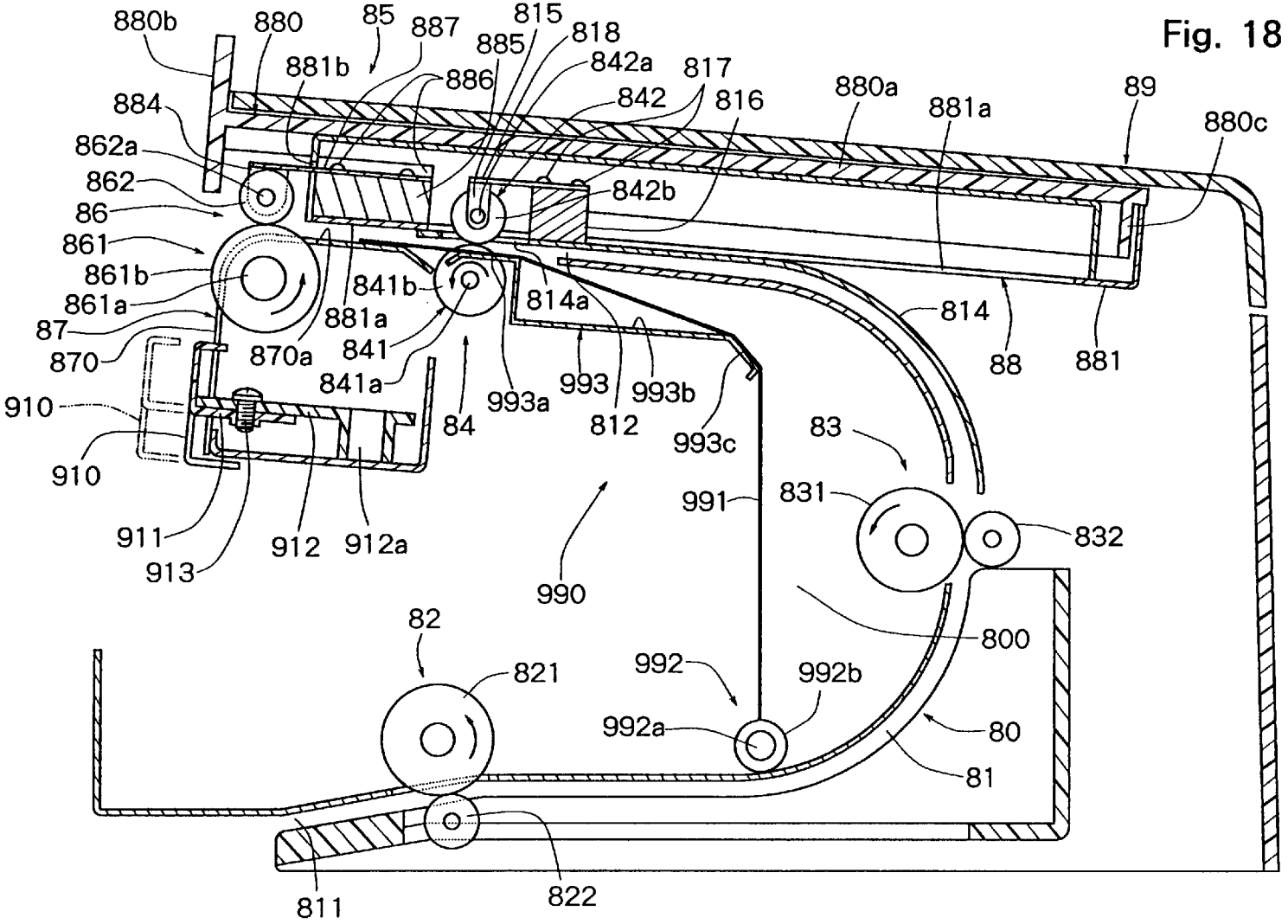
FIG. 18 is an enlarged sectional view of another embodiment of the document reversing means and the document discharge means in the automatic document feeder shown in FIG. 1.
Figure 19:
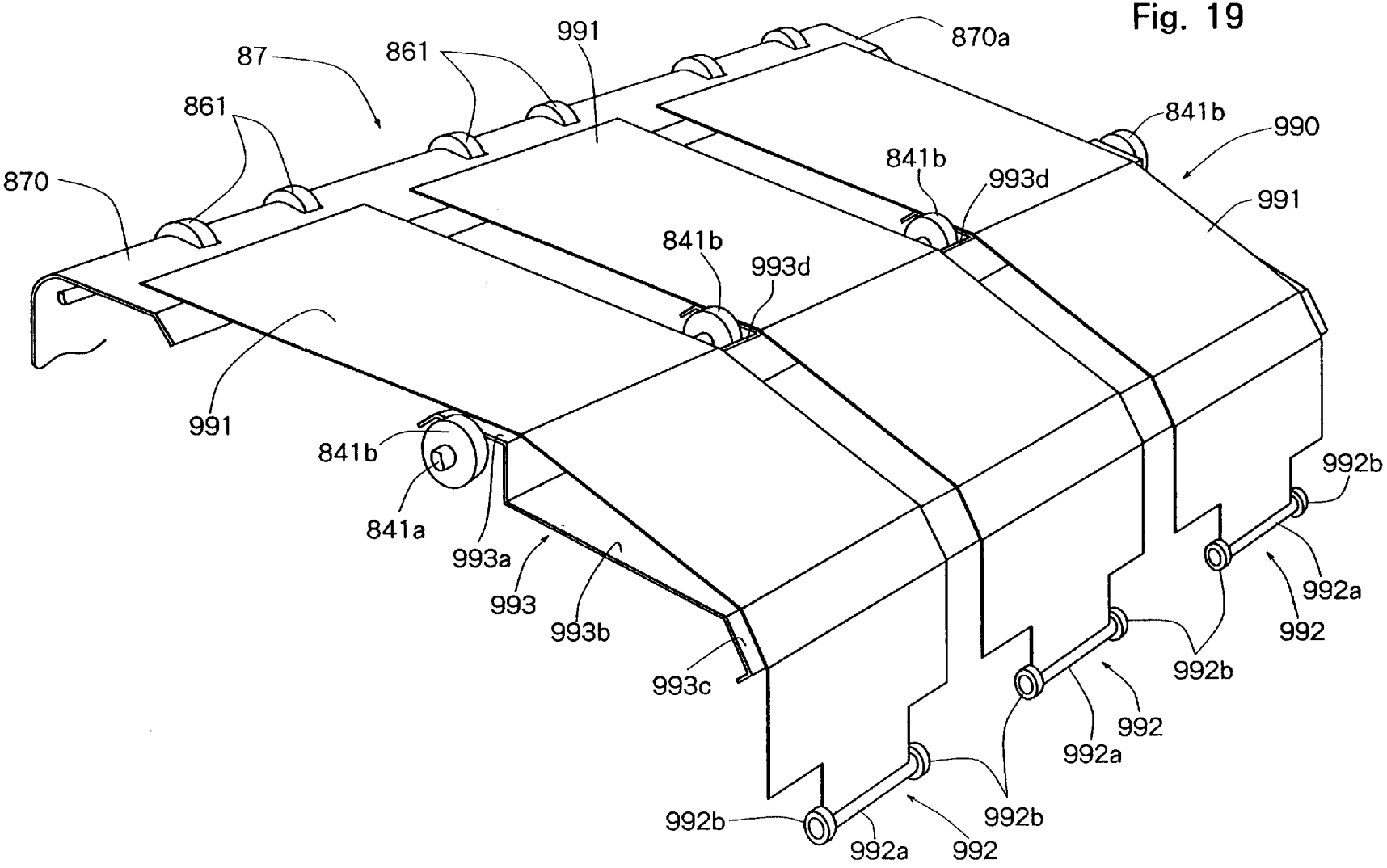
FIG. 19 is an essential part perspective view of a document guide means provided in the document discharge means shown in FIG. 18.
Figure 20:
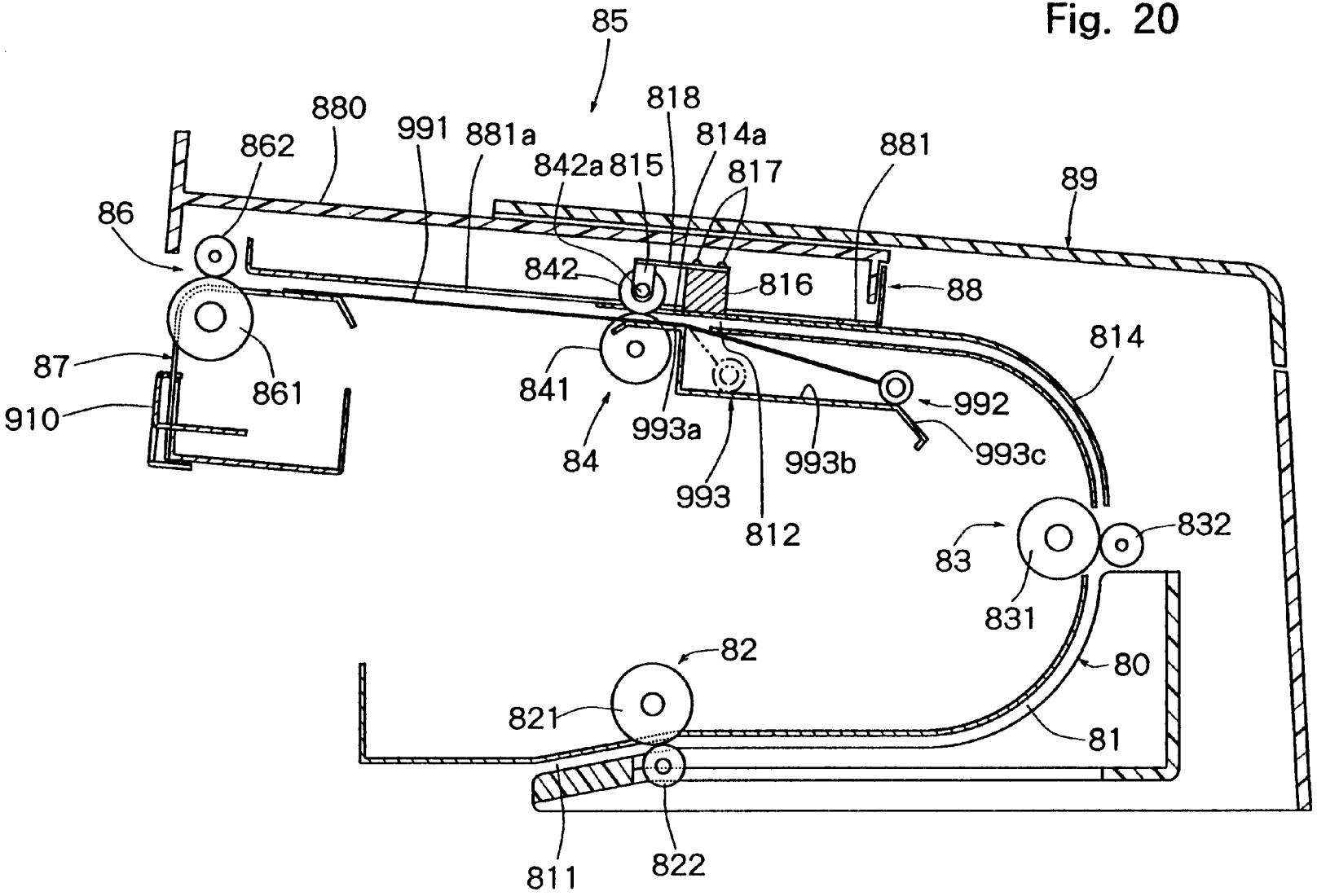
FIG. 20 is an essential part sectional view showing a state in which the document discharge means shown in FIG. 18 has been moved in the document conveying direction.

Next, FIGS. 18 to 20 will be referred to for describing another embodiment of the document guide means constituting the lower guide portion of the document transport path between the reverse transport path 81 and the document discharge means 85 in response to the movement of the document discharge means 85. In this embodiment, the parts other than the document guide means are substantially the same as in the embodiment shown in FIGS. 1 to 17. Thus, the same members as described earlier will have the same designations, and their descriptions will be omitted.

A document guide means 990 shown in FIGS. 18 to 20 includes a guide sheet 991 comprising a flexible sheet member such as a plastic film, a weight member 992 mounted to the end of the guide sheet 991, and a guide member 993 guiding the movement of the guide sheet 991.

The guide sheet 991 in the illustrated embodiment, as shown in FIG. 19, is composed of three polyethylene terephthalate (PETP) sheets which have undergone antistatic treatment. These three of the guide sheets 991 are disposed widthwise with predetermined spacing on the top of the guide member 993. One end of the guide sheet 991 is secured by an adhesive or the like to the top of the guide portion 870*a* of the support member 870 constituting the drive roller support means 87, and the weight member 992 is mounted to the other end of the guide sheet 991.

The weight member 992 comprises a weight shaft 992*a* attached to the other end of the guide sheet 991, and rollers 992*b*, 992*b* rotatably mounted on both ends of the weight shaft 992*a*. Because of this weight member 992, the guide sheet 991 is housed, in an always tensioned state, in an empty space 800 of the document reversing means 80. Since the guide sheet 991 is always under tension, entanglement never occurs in the empty space 800 of the document reversing means 80. If the guide sheet 991 is composed of a fully flexible sheet member, the other end part of the guide sheet 991 is guided by the guide member 993 and is able to extend downward, so that the weight member 992 need not absolutely be mounted.

The guide member 993 is disposed between the side plates 11 and 11. The guide member 993 has a first guide surface 993*a*, a second guide surface 993*b* and a third guide surface 993*c*, and can be constructed, for example, by bending a steel sheet. The first guide surface 993*a* constituting the guide member 993 is nearly coplanar with the top of the guide portion 870*a* of the support member 870 constituting the drive roller support means 87. The second guide surface 993*b* is formed below the first guide surface 993*a* with a difference in level being provided therebetween. The third guide surface 993*c* is downwardly inclined from the edge of the second guide surface 993*b*.

On the top of the so constructed guide member 993, the guide sheet 991 is disposed. In accordance with the movement of the document discharge means 85, the guide sheet 991 moves along the first guide surface 993*a* and the third guide surface 993*c*, while the weight member 992 moves along the third guide surface 993*c* and the second guide surface 993*b*.

Under the first guide surface 993*a* constituting the guide member 993, a drive roller 841 constituting the transport roller pair 84 is disposed. The drive roller 841 is composed of a rotating shaft 841*a*, and four rollers 841*b* mounted on the rotating shaft 841*a*. The rotating shaft 841*a* is rotationally driven in the direction of the arrow by a drive mechanism (not shown). The four rollers 841*b* constituting the drive roller 841 are disposed between both sides of the guide member 993 and the three guide sheets 991. The two rollers 841*b*, 841*b* disposed in the spaces between the adjacent guide sheets 991 are constituted to have their outer peripheral surfaces protruding from the first guide surface 993*a* through the openings 993*d*, 993*d* formed in the guide member 993. The two rollers 841*b*, 841*b* disposed on both sides of the guide member 993 are also constituted to have their outer peripheral surfaces protruding from the first guide surface 993*a*.

Above the drive roller 841, four driven rollers 842 are disposed which pair up with the four rollers 841*b*. To dispose these four driven rollers 842, four openings 814*a* are provided in a front end part of the outer guide plate 814 forming the reverse transport path 81. Through these four openings 814*a*, the four driven rollers 842 are disposed opposite the four rollers 841*b* constituting the drive roller 841. These four driven rollers 842 have their rotating shafts 842*a* rotatably mounted by a support bracket 815, and the support bracket 815 is mounted to a roller support plate 818 comprising a spring steel having one end portion fixed by machine screws 817 to a mounting member 816 secured to the outer guide plate 814 forming the reverse transport path 81. Thus, the driven rollers 842 are pressed against the rollers 841*b*, constituting the drive roller 841, by the spring force of the roller support plate 818. The guide member 881 constituting the document guide member 88 has four elongated grooves 881*a* through which the four rollers 842*b* constituting the driven rollers 842 are passed so as to be capable of relative movement.

The document guide means 990 shown in FIGS. 18 to 20 is constructed as described above. Its actions will be explained below.

When the document to be used is of the A3 size, the document discharge means 85 is positioned in the state shown in FIG. 18. The guide sheet 991 and weight member 992 of the document guide means 990 are also positioned in the illustrated state.

When the document has changed to, say, the size B5, the document discharge means 85 is moved forward in the document conveying direction from the state shown in FIG. 18 to a predetermined position corresponding to the document size as shown in FIG. 20. As the document discharge means 85 is moved, the guide sheet 991 having one end secured to the support member 870 constituting the drive roller support means 87 of the document discharge means 85 also moves. Thus, the other end of the guide sheet 991 and the weight 992 are also lifted from the empty space 800. At this time, the guide sheet 991 is guided by the third guide surface 993*c* of the guide member 993, and successively sent toward the first guide surface 993*a*. After the other end portion of the guide sheet 991 is guided to the third guide surface 993*c*, the weight 992 ascends to the third guide surface 993*c*, and travels to the position indicated by the two-dot chain line in FIG. 20 while being guided by the third guide surface 993*c* and the second guide surface 993*b*. On this occasion, the weight member 992, comprising the weight shaft 992*a* and the rollers 992*b*, 992*b* rotatably mounted at both sides of the weight shaft 992*a*, can smoothly travel since the rollers 992*b*, 992*b* roll on the third guide surface 993*c* and the second guide surface 993*b*. In this way, the guide sheet 991 is pulled out and moved as the document discharge means 85 moves. Consequently, between the downstream end of the reverse transport path 81 and the drive roller support means 87 of the document discharge means 85, a nearly horizontal document transport path is formed by the guide member 881 and the guide sheet 991, and the guide sheet 991 forms the lower guide portion of this newly formed document transport path. The guide sheet 991 forming the lower guide portion of the document transport path has been subjected to antistatic treatment, and thus can prevent the charging of the document transport path. Hence, adverse influence on the other electric components by the charging of the document transport path can be avoided.

When the document discharge means 85 is moved backward from the state shown in FIG. 20, the guide sheet 991 does an action opposite to that described above during the movement of the document discharge means 85. As a result, the guide sheet 991 is returned to the empty space 800, and positioned at the position shown in FIG. 18. Even when the document discharge means 85 is brought to a suitable position between the position shown in FIG. 18 and the position shown in FIG. 20 depending on the size of the document used, a nearly horizontal document transport path is formed by the guide member 881 and the guide sheet 991 between the downstream end of the reverse transport path 81 and the drive roller support means 87 of the document discharge means 85. The guide sheet 991 forms the lower guide portion of the formed document transport path.

The present invention, described above based on the illustrated embodiments, has the following actions and effects:

According to the first aspect of the invention, the drive source for driving the discharge roller disposed in the document discharge means is disposed at the stationary part. Thus, the document discharge means adapted to be movable in the document conveying direction can be made compact and lightweight. Since the drive source is disposed at the stationary part, moreover, the drive source does not move when the document discharge means moves in the document conveying direction, so that the wiring from the power source to the drive source is simple. Furthermore, the disposition of the drive source at the stationary part enables the drive source to be used concurrently as a drive source for other devices.

According to the second aspect of the invention, the reverse transport path constituting the document reversing means has the send-out port formed curvedly so as to be positioned above the document table by a predetermined amount. Thus, the curvature of the reverse transport path can be increased without increasing the height from the document conveying means to the document table. Furthermore, the document discharge means has the document guide means constituting the lower guide portion of the document transport path between the reverse transport path and the document discharge means in response to the movement in the document conveying direction. Hence, the document to be discharged can be guided reliably, no matter what position the document discharge means is moved to.

The document guide means also comprises a flexible sheet member having one end attached to a roller support means for supporting the discharge roller, and a winding means having the other end of the sheet member attached thereto for winding up or winding off the sheet member. Thus, the sheet member constituting the lower guide portion of the document transport path is accommodated in the apparatus in a compact manner, so that the entire apparatus can be downsized.

The winding means comprises a winding roller disposed at a stationary part and having the other end of the sheet member attached thereto, and a winding roller actuating means for rotating the winding roller in response to the movement of the document discharge means. Thus, the sheet member can be wound up or wound off by an amount corresponding to the amount of movement of the document discharge means.

The document guide means also comprises the flexible sheet member having one end attached to the roller support means for supporting the discharge roller, and a guide member for guiding the sheet member in response to the movement of the document discharge means. Thus, that portion of the sheet member which takes no part in the formation of the document transport path when the document discharge means has been moved back is bent at the edge of the guide member and accommodated in the empty space of the document reverse means. This obviates the need for a special drive means for moving the sheet member forward or backward in response to the movement of the document discharge means. Thus, a simple-structured, low-price automatic document feeder can be obtained.

Furthermore, a weight member is provided at the other end of the sheet member, and always imparts tension to the sheet member. Thus, the sheet member can surely function as the lower guide portion of the document transport path. Also, the sheet member can reliably move without undergoing entanglement, even if the empty space is of a relatively complicated shape. In addition, the weight member is composed of a weight shaft, and rollers rotatably mounted on both ends of the weight shaft. Thus, the above-mentioned movement on the guide member is smoothly carried out by the rolling of the rollers.

Besides, the sheet member is composed of a plastic sheet, thus reducing the costs for the apparatus components. In addition, the plastic sheet has been antistatic-treated, thus preventing the charging of the document transport path. This can avoid adverse influence on the other electrical components owing to the charging of the document transport path.

What I claim is:

1. An automatic document feeder comprising:

a document table for bearing documents;

feed means for feeding set documents placed on the document table;

document conveying means for conveying a document, fed by the feed means, to a document exposure position;

a document reversing means for reversing and conveying the document dispatched from the document conveying means; and document discharge means having a discharge roller for discharging the document, sent by the document reversing means, onto the document table, said document discharge means being movable in the document conveying direction, the document discharge means further including a drive pulley mounted on an end portion of the discharge roller;

a pair of transmission pulleys disposed outside a moving range of the drive pulley in the document conveying direction, and rotatably supported at a stationary part;

a timing belt looped between the pair of transmission pulleys and the drive pulley; and a drive source transmittingly connected to one of the pair of transmission pulleys and disposed at a stationary part.

2. An automatic document feeder comprising:

a document table for bearing documents;

feed means for feeding set documents placed on the document table;

document conveying means for conveying a document, fed by the feed means, to a document exposure position;

document reversing means for reversing and conveying the document dispatched from the document conveying means; and document discharge means having a discharge roller for discharging the document, sent by the document reversing means, onto the document table, the document discharge means being movable in the document conveying direction wherein a reverse transport path constituting the document reversing means is formed so as to be curved and to have its send-out port positioned above the document table by a predetermined amount, the document discharge means has document guide means constituting a lower guide portion of a document transport path between the reverse transport path and the document discharge means in response to movement of the document discharge means in the document conveying direction, and the document guide means includes a flexible sheet member having one end attached to a roller support means for supporting the discharge roller, and winding means having the other end of the flexible sheet member attached thereto for winding up or winding off the sheet member.

3. The automatic document feeder of claim 2, wherein the winding means includes a winding roller disposed at a stationary part and having the other end of the sheet member attached thereto, and a winding roller actuating means for rotating the winding roller in response to the movement of the document discharge means.

4. The automatic document feeder of claim 3, wherein the winding roller actuating means includes a roller drive pulley mounted at an end portion of the winding roller and having the same diameter as that of the winding roller, a transmission pulley disposed with a predetermined spacing from the roller drive pulley in the document conveying direction, and a transmission belt looped between the roller drive pulley and the transmission pulley and connected to part of the document discharge means.

5. An automatic document feeder comprising:

a document table for bearing documents;

feed means for feeding set documents placed on the document table;

document conveying means for conveying a document, fed by the feed means, to a document exposure position;

document reversing means for reversing and conveying the document dispatched from the document conveying means; and document discharge means having a discharge roller for discharging the document, sent by the document reversing means, onto the document table, the document discharge means being movable in the document conveying direction wherein a reverse transport path constituting the document reversing means is formed so as to be curved and to have its send-out port positioned above the document table by a predetermined amount, the document discharge means has document guide means constituting a lower guide portion of a document transport path between the reverse transport path and the document discharge means in response to movement of the document discharge means in the document conveying direction, and the document guide means includes a flexible sheet member having one end attached to a roller support means for supporting the discharge roller, and a guide member for guiding the flexible sheet member in response to the movement of the document discharge means.

6. The automatic document feeder of claim 5, wherein a weight member is provided at the other end of the flexible sheet member.

7. The automatic document feeder of claim 6, wherein the weight member is composed of a weight shaft, and rollers rotatably mounted on both ends of the weight shaft.

8. The automatic document feeder of claim 5, wherein the flexible sheet member is composed of a plastic sheet.

9. The automatic document feeder of claim 8, wherein the plastic sheet has been subjected to antistatic treatment.

* * * * *